US010626692B2

(12) United States Patent
Drenth et al.

(10) Patent No.: US 10,626,692 B2
(45) Date of Patent: Apr. 21, 2020

(54) OVERSHOT ASSEMBLY AND SYSTEMS AND METHODS OF USING SAME

(71) Applicant: BLY IP INC., Salt Lake City, UT (US)

(72) Inventors: Christopher L. Drenth, Burlington (CA); Anthony Lachance, Mississauga (CA)

(73) Assignee: BLY IP INC., Salt Lake City, UT (US)

( * ) Notice: Subject to any disclaimer, the term of this patent is extended or adjusted under 35 U.S.C. 154(b) by 145 days.

(21) Appl. No.: 15/240,142

(22) Filed: Aug. 18, 2016

(65) Prior Publication Data

US 2017/0051571 A1 Feb. 23, 2017

Related U.S. Application Data

(60) Provisional application No. 62/206,556, filed on Aug. 18, 2015.

(51) Int. Cl.
*E21B 31/18* (2006.01)
*E21B 25/00* (2006.01)

(52) U.S. Cl.
CPC ..... *E21B 31/18* (2013.01); *E21B 25/00* (2013.01)

(58) Field of Classification Search
CPC ..... E21B 31/18; E21B 25/00
See application file for complete search history.

(56) References Cited

U.S. PATENT DOCUMENTS 2,179,594 A 11/1939 Johnson
3,173,719 A 3/1965 Maurycy
3,186,745 A 6/1965 Ray
4,281,725 A 8/1981 Runk
4,591,197 A 5/1986 Akkerman
6,089,335 A 7/2000 Able
2002/0038727 A1 4/2002 Moore et al.
2006/0108789 A1* 5/2006 Hughes ..... F16L 55/1608 285/15
2007/0259744 A1 11/2007 Lehtovaara et al.
2009/0283327 A1 11/2009 Drenth et al.
2010/0012383 A1 1/2010 Drenth
(Continued)

FOREIGN PATENT DOCUMENTS

AU 2013361158 12/2013
WO WO-2014/100559 A1 6/2014

OTHER PUBLICATIONS

International Search Report and Written Opinion dated Oct. 31, 2016, for application PCT/US2016/047499, filed on Aug. 18, 2016 (Applicant—BLY IP, Inc. // Inventor—Drenth, et al.) (22 pages).
(Continued)

*Primary Examiner* — Nicole Coy
*Assistant Examiner* — Yanick A Akaragwe
(74) *Attorney, Agent, or Firm* — Ballard Spahr LLP

(57) ABSTRACT

An overshot assembly for operative coupling to a wireline and a head assembly within a drilling system. The overshot assembly has a proximal body portion, a distal body portion, and a spindle received within the distal body portion. The distal body portion is moveable axially relative to the spindle to effect movement of a latching assembly about and between a deployed position in which the latching assembly extends radially outwardly from the distal body portion and a retracted position in which the latching assembly is received within the distal body portion.

12 Claims, 16 Drawing Sheets

(56) References Cited

U.S. PATENT DOCUMENTS

| | | | |
|---|---|---|---|
| 2011/0079435 | A1 | 4/2011 | Drenth et al. |
| 2013/0056280 | A1 | 3/2013 | Able et al. |
| 2014/0174828 | A1 | 6/2014 | Muntz et al. |
| 2014/0174832 | A1 | 6/2014 | Drenth et al. |

OTHER PUBLICATIONS

International Search Report dated Apr. 15, 2014 for Application No. PCT/US2013/076855, which was filed on Dec. 20, 2013 and published as WO 2014/100559 on Jun. 26, 2014 (Applicant—Longyear TM, Inc.) (4 pages).

Written Opinion dated Apr. 15, 2014 for Application No. PCT/US2013/076855, which was filed on Dec. 20, 2013 and published as WO 2014/100559 on Jun. 26, 2014 (Applicant—Longyear TM, Inc.) (6 pages).

International Preliminary Report on Patentability dated Apr. 15, 2014 for Application No. PCT/US2013/076855, which was filed on Dec. 20, 2013 and published as WO 2014/100559 on Jun. 26, 2014 (Applicant—Longyear TM, Inc.) (7 pages).

Patent Examination Report dated Dec. 3, 2015 by the Australian Patent Office for AU Application No. 2013361158, which was filed on Dec. 20, 2013(Inventor—Drenth et al; Applicant—Longyear TM, Inc.) (3 pages).

Second Patent Examination Report dated Apr. 11, 2016 by the Australian Patent Office for AU Application No. 2013361158, which was filed on Dec. 20, 2013(Inventor—Drenth et al; Applicant—Longyear TM, Inc.) (3 pages).

Office Action dated May 31, 2016 by the Canadian Patent Office for CA Application No. 2890851, which was filed on Dec. 20, 2013 (Inventor—Drenth et al; Applicant—Longyear TM, Inc.) (4 pages).

Communication Pursuant to Rules 161 (2) and 162 EPC dated Jul. 31, 2015 by the European Patent Office for EP Application No. 13863927.3, which was filed on Dec. 20, 2013 and published as 2935782 on Oct. 28, 2015 (Inventor—Drenth et al; Applicant—Longyear TM, Inc.) (2 pages).

Non Final Rejection dated Jun. 7, 2016 by the U.S. Patent and Trademark Office for U.S. Appl. No. 14/135,965, filed Dec. 20, 2013 and published as US 2014-0174832 A1 on Jun. 26, 2014 (Inventor—Drenth et al; Applicant—Longyear TM, Inc.) (13 pages).

Response to Non Final Rejection dated Sep. 7, 2016 for U.S. Appl. No. 14/135,965, filed Dec. 20, 2013 and published as US 2014-0174832 A1 on Jun. 26, 2014 (Inventor—Drenth et al; Applicant—Longyear TM, Inc.) (10 pages).

Final Rejection dated Oct. 3, 2016 by the U.S. Patent and Trademark Office for U.S. Appl. No. 14/135,965, filed Dec. 20, 2013 and published as US 2014-0174832 A1 on Jun. 26, 2014 (Applicant—Longyear TM, Inc.; Inventor—Christopher L. Drenth et al) (7 pages).

Response to Final Rejection dated Oct. 21, 2016 to the U.S. Patent and Trademark Office for U.S. Appl. No. 14/135,965, filed Dec. 20, 2013 and published as US 2014-0174832 A1 on Jun. 26, 2014 (Applicant—Longyear TM, Inc.; Inventor—Christopher L. Drenth et al) (11 pages).

Notice of Allowance dated Oct. 27, 2016 by the U.S. Patent and Trademark Office for U.S. Appl. No. 14/135,965, filed Dec. 20, 2013 and published as US 2014-0174832 A1 on Jun. 26, 2014 (Applicant—Longyear TM, Inc.; Inventor—Christopher L. Drenth et al) (5 pages).

Notice of Acceptance dated Nov. 23, 2016 by the U.S. Patent and Trademark Office for AU Application No. 2013361158, which was filed on Dec. 20, 2013(Applicant—Longyear TM, Inc.; Inventor—Christopher L. Drenth et al) (2 pages).

U.S. Appl. No. 14/135,965 (US2014/0174832-A1, filed Dec. 20, 2013 (Jun. 26, 2014), Drenth et al (Longyear TM, Inc.).

* cited by examiner

OVERSHOT ASSEMBLY AND SYSTEMS AND METHODS OF USING SAME

CROSS-REFERENCE TO RELATED APPLICATION

This application claims priority to and the benefit of the filing date of U.S. Provisional Patent Application No. 62/206,556, filed Aug. 18, 2015, which is incorporated by reference herein in its entirety.

FIELD

This application relates generally to overshot assemblies for use in drilling operations. In use, the overshot assemblies are typically positioned between and operatively coupled to a wireline and a head assembly of a drilling system.

BACKGROUND

During conventional drilling, after an inner tube of a head assembly is full of a sample, an overshot assembly is lowered (or pumped) toward the bottom of a drill hole to retrieve the head assembly. Conventional overshot assemblies include heavy-duty lifting dogs that are configured to securely grab a spearhead (spearpoint) that is coupled to the proximal end of the head assembly. After engagement between the lifting dogs and the spearhead, the overshot is retrieved from the drill hole, and the sample is extracted from the inner tube.

Spearheads and locking dogs are typically formed by a casting process. Due to the nature of the casting process, the material of the spearhead and locking dogs is typically of reduced quality, more easily distorted, and less wear-resistant when compared to machined materials. Additionally, existing spearheads and locking dogs only function together within a narrow range of relative orientations. Due to these limitations, it can be challenging to achieve proper engagement between existing spearheads and locking dogs when conditions within the drill hole are not ideal.

Some recent overshot assemblies have been designed to address one or more of the above-identified issues. However, these overshot assemblies are mechanically complex, with a large number of parts, and can be difficult to install and/or assemble. Additionally, these overshot assemblies are likely to experience undesired corrosion.

Accordingly, there is a need in the pertinent art for an overshot assembly that is easier to install and assemble and more robust, reliable, and corrosion-resistant than existing overshot assemblies. There is a further need in the pertinent art for an overshot assembly that retains these properties over a wide range of angular orientations.

SUMMARY

Described herein is an overshot assembly having a proximal body portion, a distal body portion, a spindle, and a latching assembly. The distal body portion can have a wall and a longitudinal axis. The wall of the distal body portion can have an inner surface, an outer surface, and a proximal end. The inner surface of the wall of the distal body portion can define a central bore of the distal body portion. The spindle can be at least partially received within the central bore of the distal body portion. The spindle can have an outer surface, a proximal portion, and a distal portion. The latching assembly can be operatively coupled to the distal body portion and configured for movement about and between a retracted position and a deployed position. The distal body portion can be configured for axial advancement relative to the spindle, and the spindle can be configured for axial movement but not rotational movement relative to the longitudinal axis of the distal body portion. In use, axial advancement of the distal body portion in a proximal direction relative to the spindle can be configured to effect movement of the latching assembly from its deployed position toward its retracted position.

Also described herein is an overshot assembly having a proximal body portion, a distal body portion, a sleeve subassembly, a spindle, a drive element and an engagement subassembly. The distal body portion can have a wall. The wall of the distal body portion can have an inner surface, an outer surface, and a proximal end, and the inner surface of the wall of the distal body portion can define a central bore of the distal body portion. The sleeve subassembly can define a central bore and have a common longitudinal axis with the distal body portion. The central bore of the sleeve subassembly can have proximal and distal portions. The sleeve subassembly can define a first seat within the central bore of the sleeve subassembly. The spindle can be at least partially received within the central bores of the sleeve subassembly and the distal body portion. The spindle can have an outer surface, a proximal portion, and a distal portion. The drive element can be secured to the proximal portion of the spindle. The engagement subassembly can be operatively coupled to the sleeve subassembly and project radially inwardly within the central bore of the sleeve subassembly. The sleeve subassembly can be configured for rotation about and between a locked position and an unlocked position. In the locked position, the drive element can abut the first seat defined by the sleeve subassembly. In the unlocked position, the sleeve subassembly can be configured for axial advancement relative to the spindle, and the drive element and the spindle can be configured for receipt within the distal portion of the central bore of the sleeve subassembly. Optionally, the overshot assembly can comprise a latching assembly operatively coupled to the distal body portion and configured for movement about and between a retracted position and a deployed position. Axial advancement of the distal body portion and the sleeve subassembly relative to the spindle can be configured to effect movement of the latching assembly from its deployed position toward its retracted position. Optionally, the overshot assembly can comprise a locking assembly operatively coupled to the distal body portion and configured for movement about and between a retracted position and a deployed position. When the sleeve subassembly is positioned in the unlocked position, the locking assembly can be moved from its deployed position toward its retracted to drive axial advancement of the sleeve subassembly relative to the spindle.

Systems and methods of using the disclosed overshot assemblies are also described.

BRIEF DESCRIPTION OF THE DRAWINGS

These and other aspects of the invention will become more apparent in the detailed description in which reference is made to the appended drawings wherein:

FIG. 2A shows the sleeve subassembly of the overshot assembly in a locked position as disclosed herein. FIG. 2B shows the sleeve subassembly of the overshot assembly in an unlocked position as disclosed herein.

FIG. 4A shows the sleeve subassembly of the overshot assembly in a locked position as disclosed herein. FIGS. 4B-4C show the sleeve subassembly of the overshot assembly in an unlocked position as disclosed herein. FIG. 4B shows the overshot assembly prior to axial advancement of the sleeve subassembly as disclosed herein, whereas FIG. 4C shows the overshot assembly following axial advancement of the sleeve subassembly as disclosed herein.

FIG. 5A shows the outer appearance of the overshot assembly when the sleeve subassembly of the overshot assembly is positioned in a locked position as disclosed herein. FIG. 5B shows the outer appearance of the overshot assembly when the sleeve subassembly of the overshot assembly is positioned in an unlocked position as disclosed herein.

FIG. 8A shows the latch assembly of the overshot assembly in a deployed position as disclosed herein. FIG. 8B shows the latch assembly of the overshot assembly in a retracted position as disclosed herein.

FIG. 9A is a front cross-sectional view of the distal body portion and spindle of such an overshot assembly. FIG. 9B is an isolated perspective view of the distal body portion of the overshot assembly of FIG. 9A. FIG. 9C is an isolated front cross-sectional view of the distal body portion of the overshot assembly of FIG. 9A.

DETAILED DESCRIPTION

Figure 1:
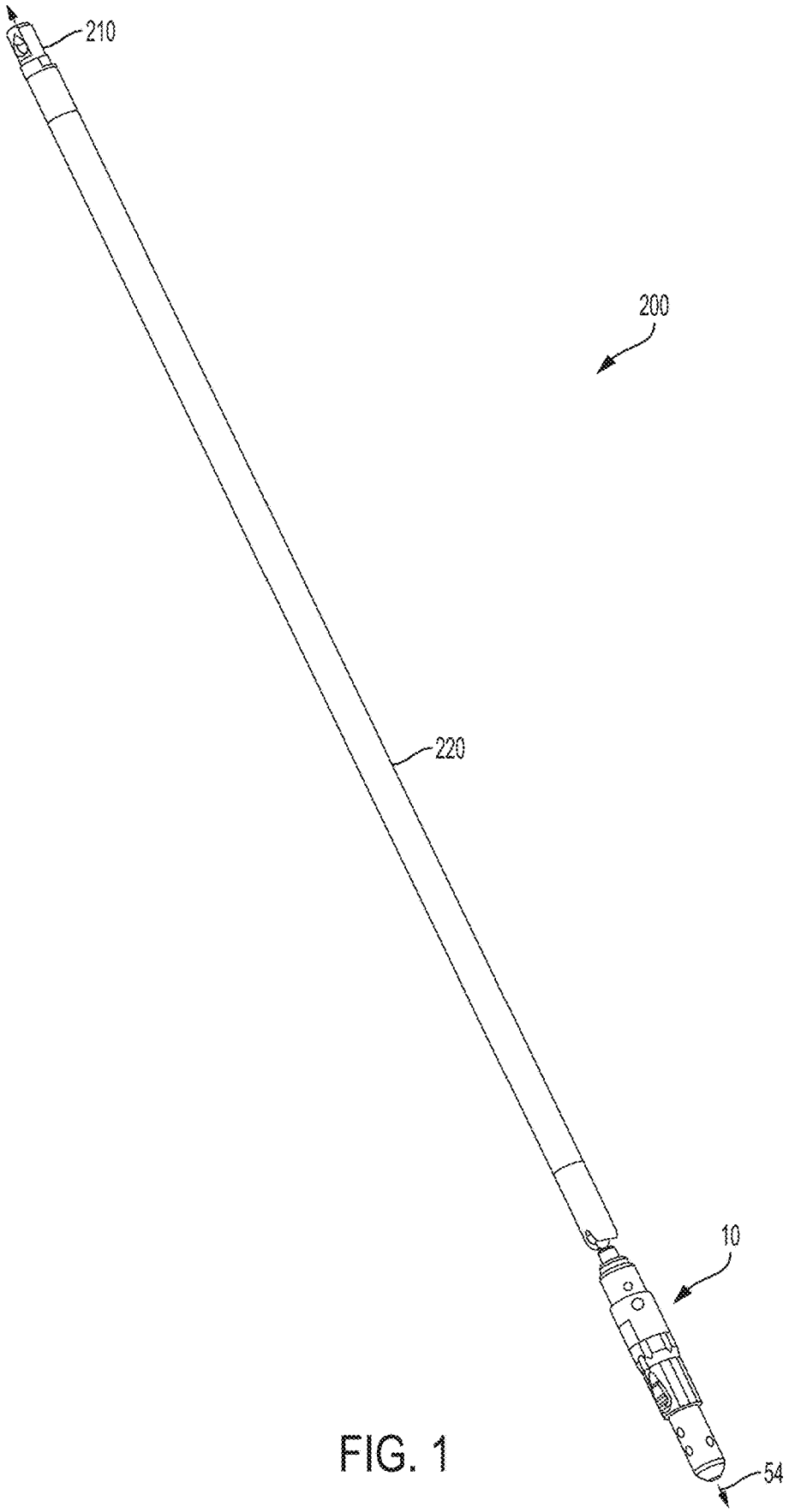
FIG. 1 is a perspective view of an overshot system having an overshot assembly as disclosed herein.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a latch member" can include two or more such latch members unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list.

As used herein, the term "proximal" refers to a direction toward the surface of a formation (where a drill rig can be located), whereas the term "distal" refers to a direction toward the bottom of a drill hole, moving away from the surface of the formation. When the terms "proximal" and "distal" are used to describe system components, it is expected that during normal use of those components, the "proximal" components will be positioned proximally (closer to the surface of the formation) relative to the "distal" components and the "distal" components will be positioned distally (closer to the bottom of a drill hole) relative to the "proximal" components.

Figure 5A:
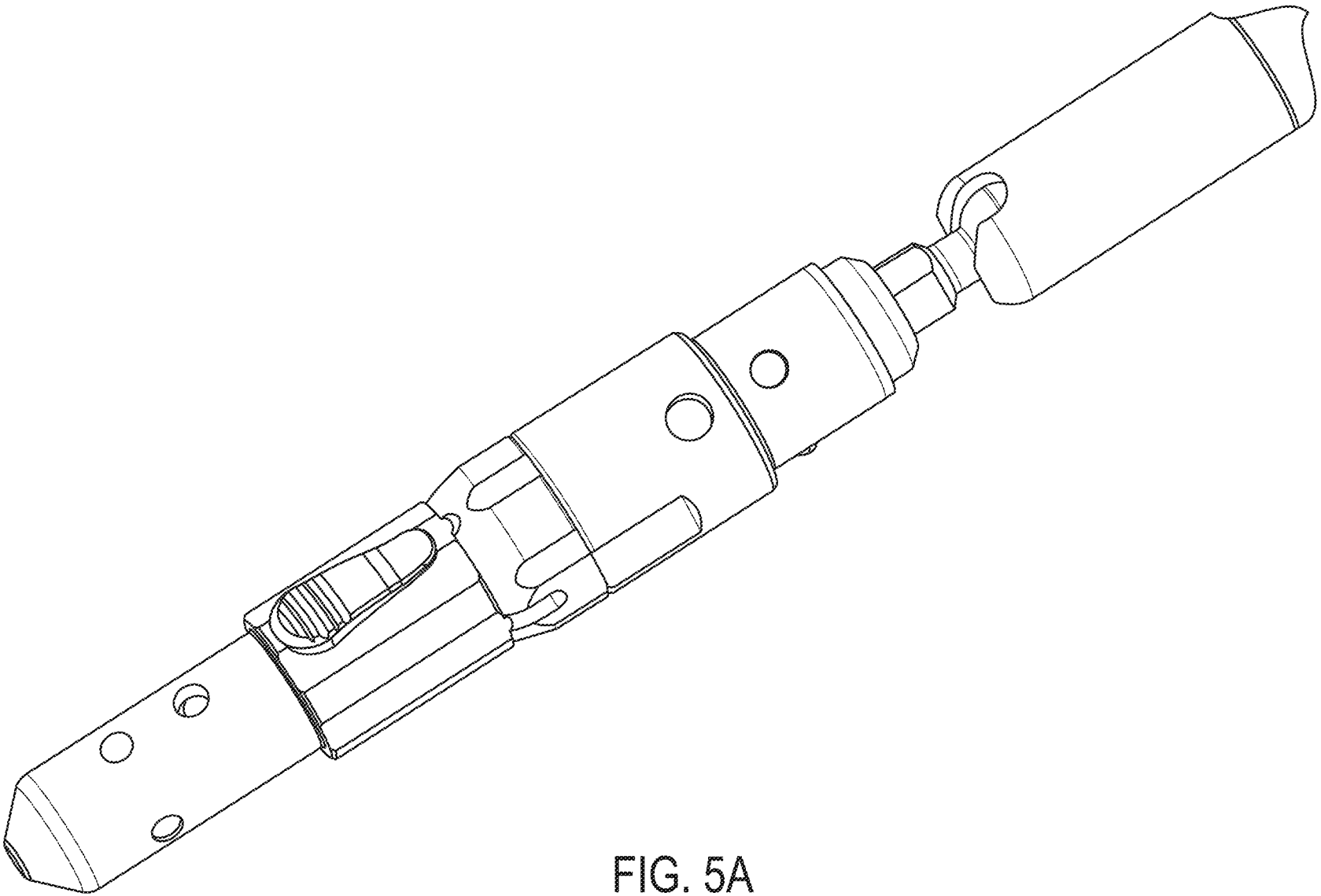
FIGS. 5A-5B are perspective views of an overshot assembly as disclosed herein.
Figure 5B:
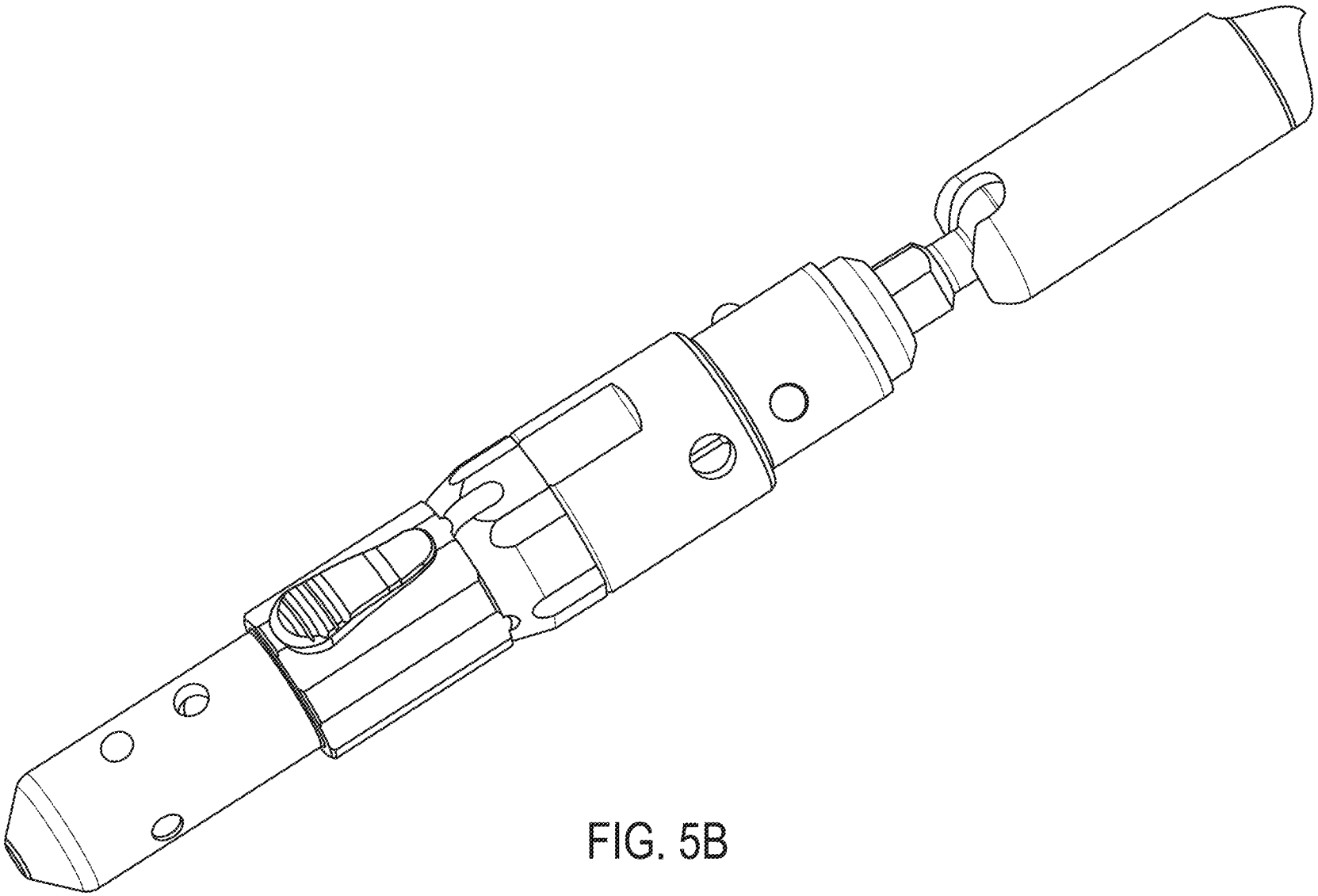
Figure 6:
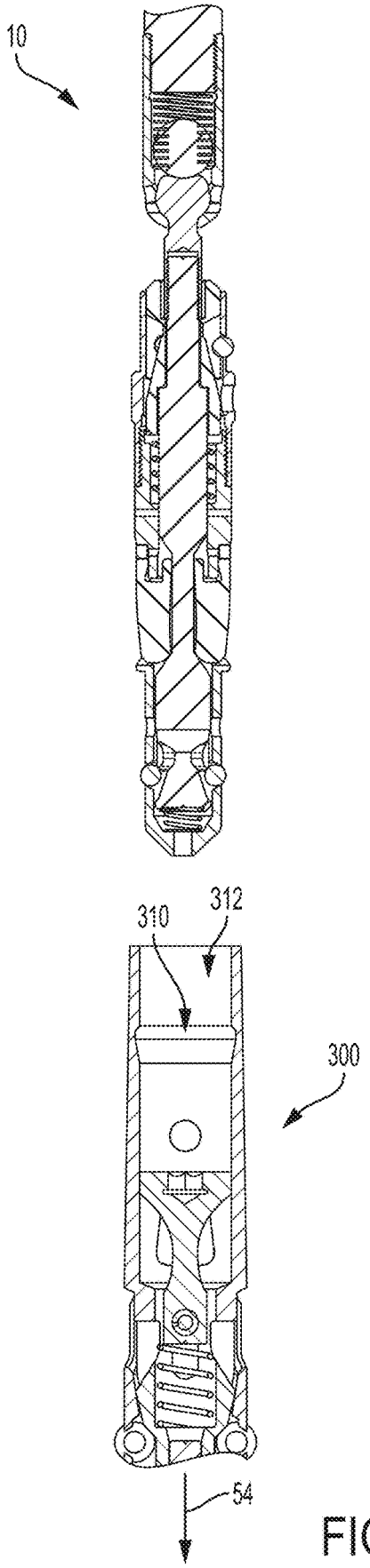
FIG. 6 is a cross-sectional front view of an exemplary drilling system having an overshot assembly as disclosed herein.

Described herein with reference to FIGS. 1-6 and 8A-9C is an overshot assembly 10 for use within a drilling system. It is contemplated that the disclosed overshot assembly 10 can be used in either underground or surface drilling applications. In exemplary aspects, the drilling system can comprise a head assembly as is known in art. It is further contemplated that the disclosed overshot assembly 10 can be configured for engagement with known head assemblies 300 following removal of the spearhead assemblies conventionally associated with such head assemblies. Alternatively, in additional exemplary aspects, it is contemplated that the overshot assembly 10 can be configured for engagement with one or more receptacles matingly received or defined within the head assembly 300. In these aspects, it is contemplated that the one or more receptacles can similarly be configured for engagement with at least a portion of the overshot assembly 10. Optionally, the one or more receptacles can comprise one or more grooves defined by an inner surface of the head assembly 300. In operation, and as shown in FIG. 6, it is contemplated that the overshot assembly 10 can be configured to engage a proximal portion 310 of the head assembly 300 to permit retrieval of the head assembly from a drill hole (for example, when the inner tube of the head assembly is full of a core sample). In another aspect, as further disclosed herein, at least a portion of the distal body portion 30 of the overshot assembly 10 can be configured for receipt within a central bore 312 of the head assembly 300. Thus, in use, the disclosed overshot assembly 10 can eliminate the need for the use of a spearhead (spearpoint).

As shown in FIG. 1, it is contemplated that the overshot assembly 10 can be provided as an overshot system 200, which can comprise one or more conventional overshot components, including, for example and without limitation, a swivel element 210, a swivel cable body 220, and a conventional porting and valve configuration. At least a portion of the overshot system, such as, for example and without limitation, the swivel element 210, can be configured for secure engagement and/or coupling with a wireline cable using known mechanisms. In exemplary aspects, the swivel element 210 can comprise an eye bolt having a curved surface configured to matingly receive and engage a loop of the wireline cable. In these aspects, the overshot system can further comprise a grease-lubricated thrust roller bearing configured to permit the eye bolt to swivel in response to excessive twisting in the wireline cable that must be relieved in order to avoid damage to the wireline cable. The overshot components depicted in FIG. 1 represent merely an example of one overshot system 200 that can be produced using the disclosed overshot assembly 10, and it is contemplated that other conventional overshot system components can be used in place of, or in combination with, those components depicted in FIG. 1. It is further contemplated that the disclosed overshot assembly 10 can be used with any known wireline cable-release apparatus.

Figure 2A:
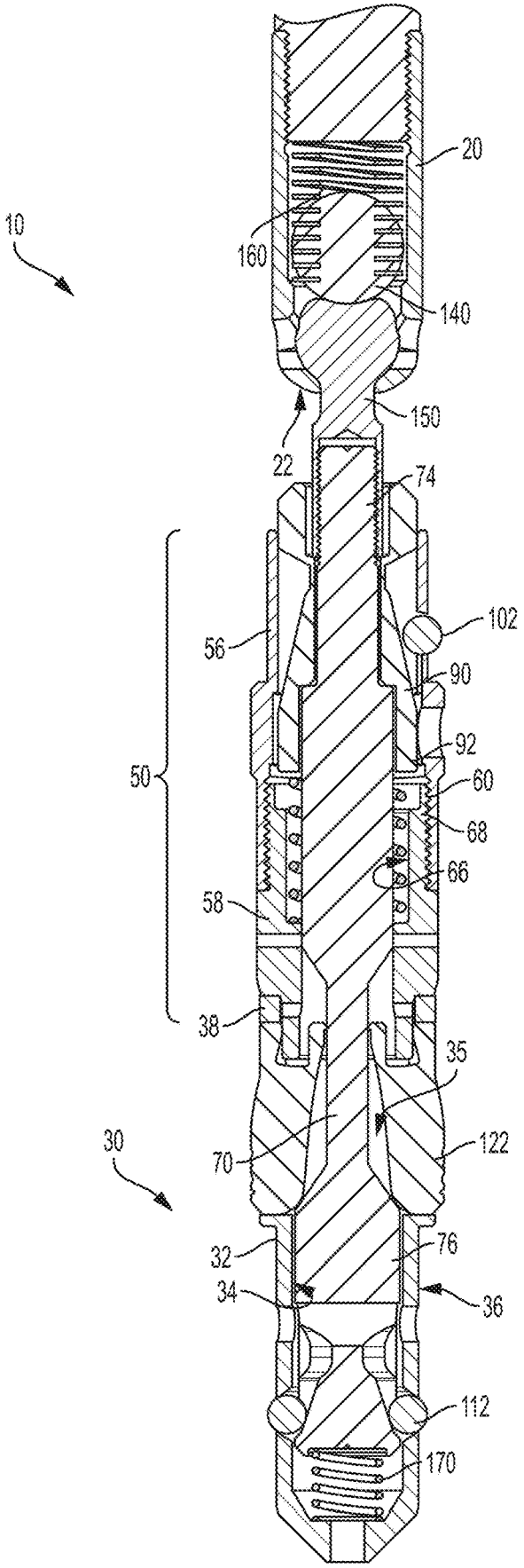
FIGS. 2A-2B are front cross-sectional views of an overshot assembly as disclosed herein.

In exemplary aspects, the overshot assembly 10 can comprise a proximal body portion 20, a distal body portion 30, and a spindle 70. In one aspect, and with reference to FIGS. 2A-2B, the distal body portion 30 can have a wall 32. In this aspect, the wall 32 of the distal body portion 30 can have an inner surface 34, an outer surface 36, and a proximal end 38. As shown in FIG. 2A, the inner surface 34 of the wall 32 of the distal body portion 30 can define a central bore 35 of the distal body portion. In use, the distal body portion 30 can be configured for axial advancement relative to the spindle (e.g., proximal or distal axial advancement), and the spindle can be configured for axial movement but not rotational movement relative to the longitudinal axis of the distal body portion.

Optionally, in exemplary aspects, the overshot assembly 10 can further comprise a sleeve subassembly 50. In an additional aspect, and with reference to FIGS. 2A-2B, the sleeve subassembly 50 can have a central bore 52 and a common longitudinal axis 54 with the distal body portion 30. In this aspect, the central bore 52 of the sleeve subassembly 50 can have proximal and distal portions 56, 58. As shown in FIG. 2A, the sleeve subassembly 50 can define a first seat 62 within the central bore 52 of the sleeve subassembly.

Figure 2B:
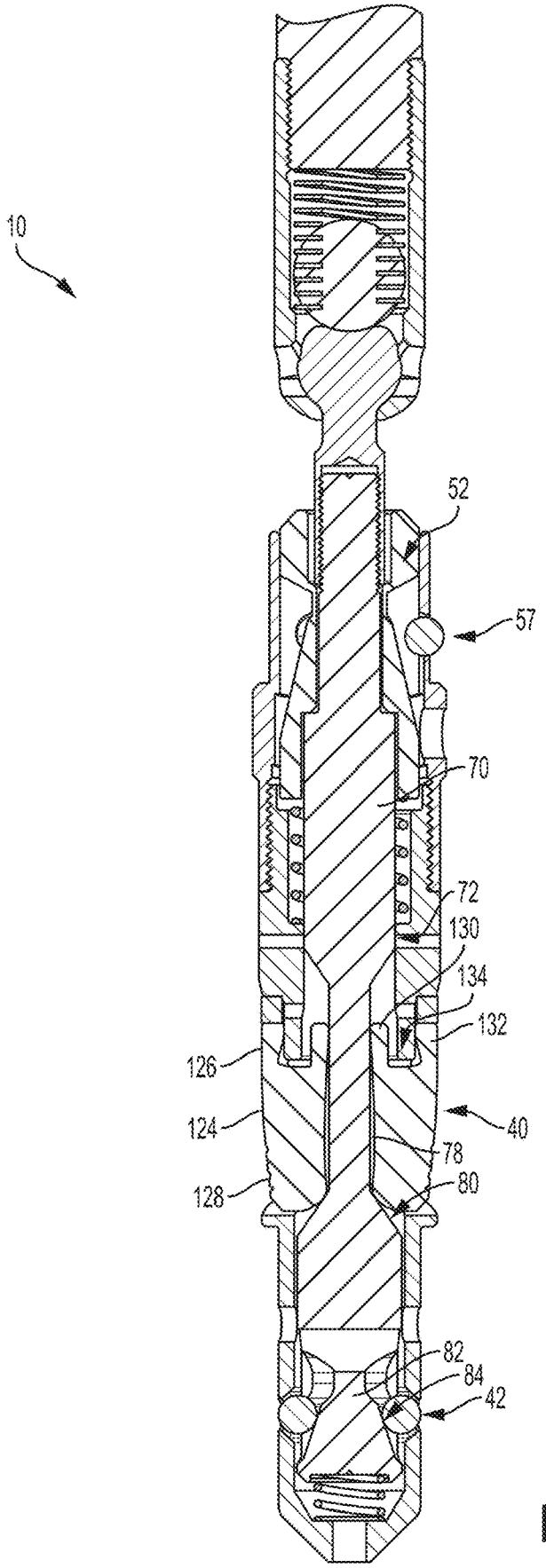
Figure 3:
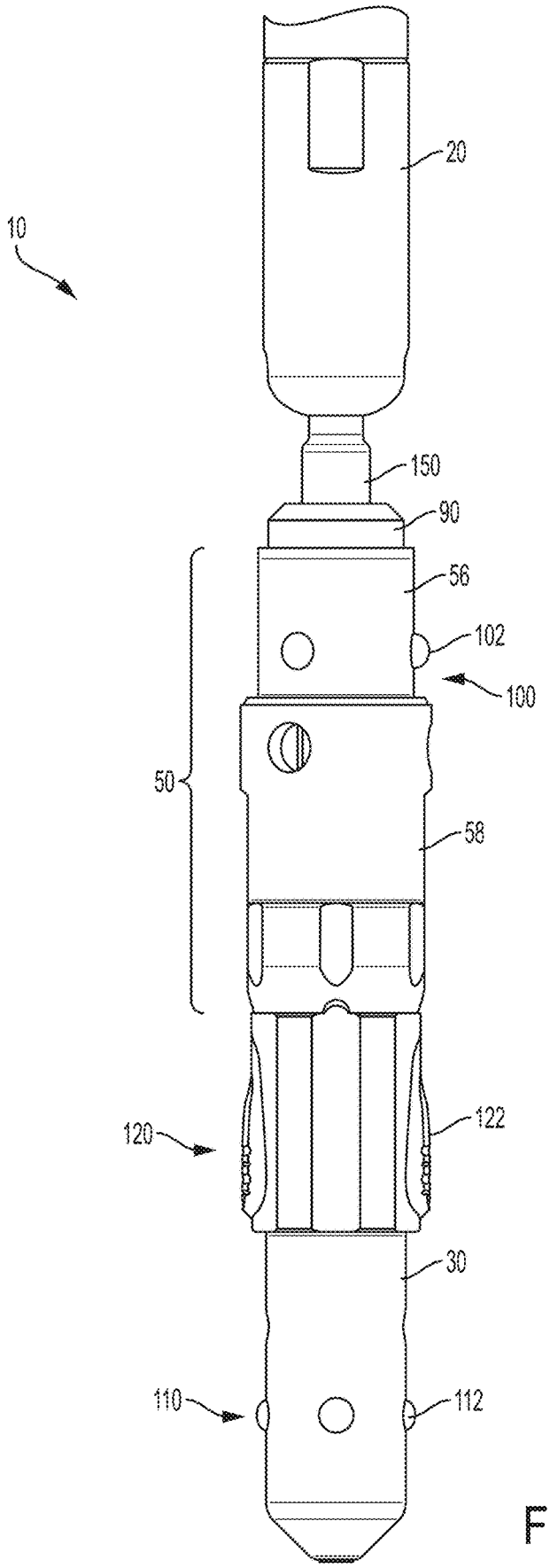
FIG. 3 is a front perspective view of an overshot assembly as disclosed herein.

In a further aspect, and with reference to FIGS. 2A-2B, the spindle 70 can be at least partially received within the central bores 35, 52 of the sleeve subassembly 30 and the distal body portion 50. In this aspect, it is contemplated that the spindle 70 can have an outer surface 72, a proximal portion 74, and a distal portion 76.

Optionally, in further exemplary aspects, the overshot assembly 10 can further comprise a drive element 90. In these aspects, and as shown in FIG. 2A, the drive element 90 can be secured to the proximal portion 74 of the spindle 70. Optionally, in this aspect, the drive element 90 and the spindle 70 can be threadingly secured to one another.

Optionally, in still further exemplary aspects, the overshot assembly 10 can further comprise an engagement subassembly 100. In an additional aspect, and with reference to FIGS. 2A-3, the engagement subassembly 100 can be operatively coupled to the sleeve subassembly 50 and project radially inwardly within the central bore 52 of the sleeve assembly. As further disclosed herein, the positioning of the engagement subassembly 100 within the central bore 52 of the sleeve assembly 50 can permit selective engagement and disengagement between the engagement subassembly and the drive element 90. In exemplary aspects, the engagement subassembly 100 can comprise at least one engagement member 102 (optionally, a plurality of engagement members). In these aspects, it is contemplated that each engagement member 102 can comprise at least one of a ball, a roller, a cam-shaped element, and the like. In further aspects, the sleeve subassembly can define at least one radial opening 57 that is configured to receive at least a portion of the at least one engagement member 102.

Figure 4A:
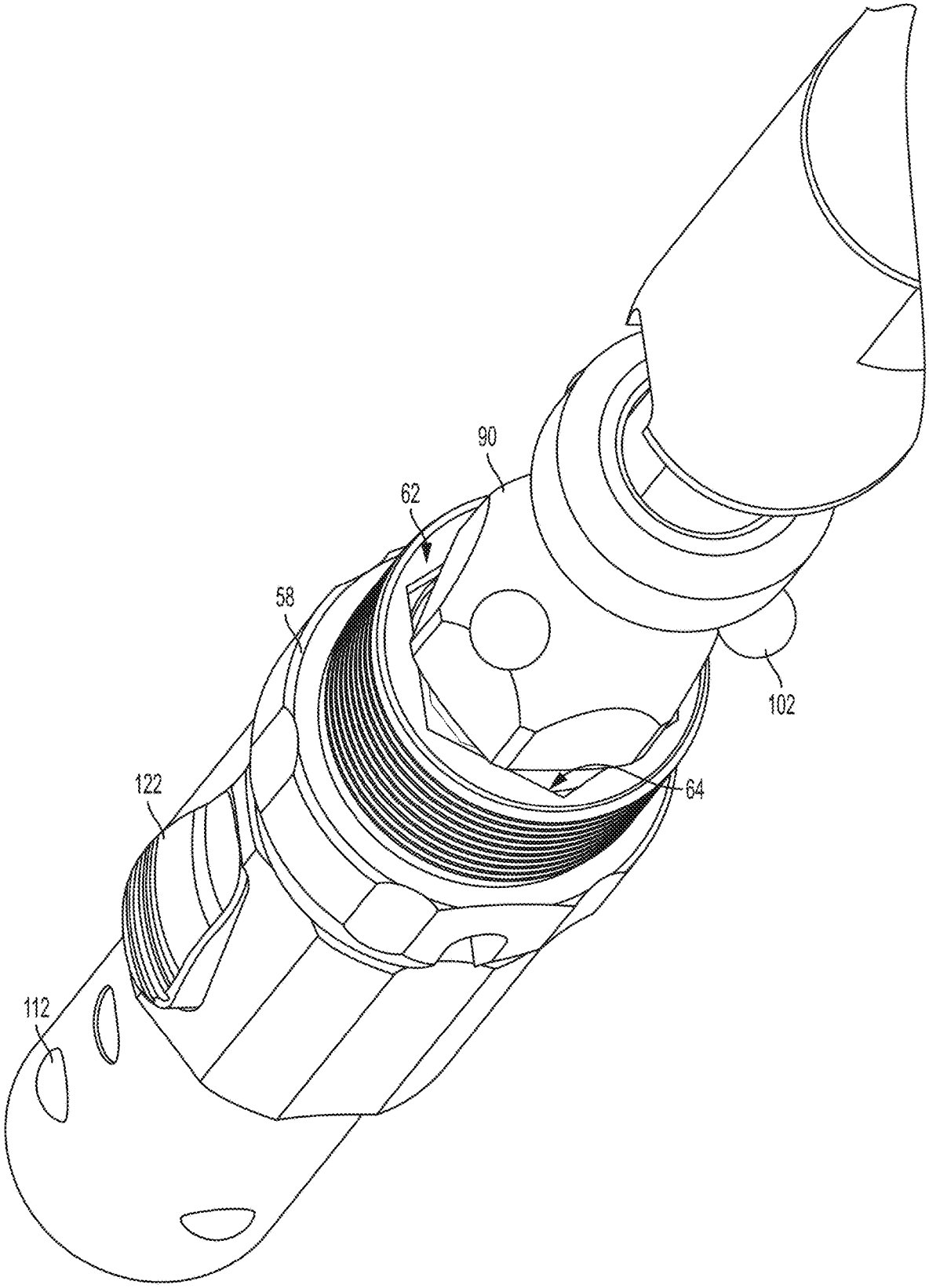
FIGS. 4A-4C are isolated, partially transparent top perspective views of an overshot assembly as disclosed herein.
Figure 4B:
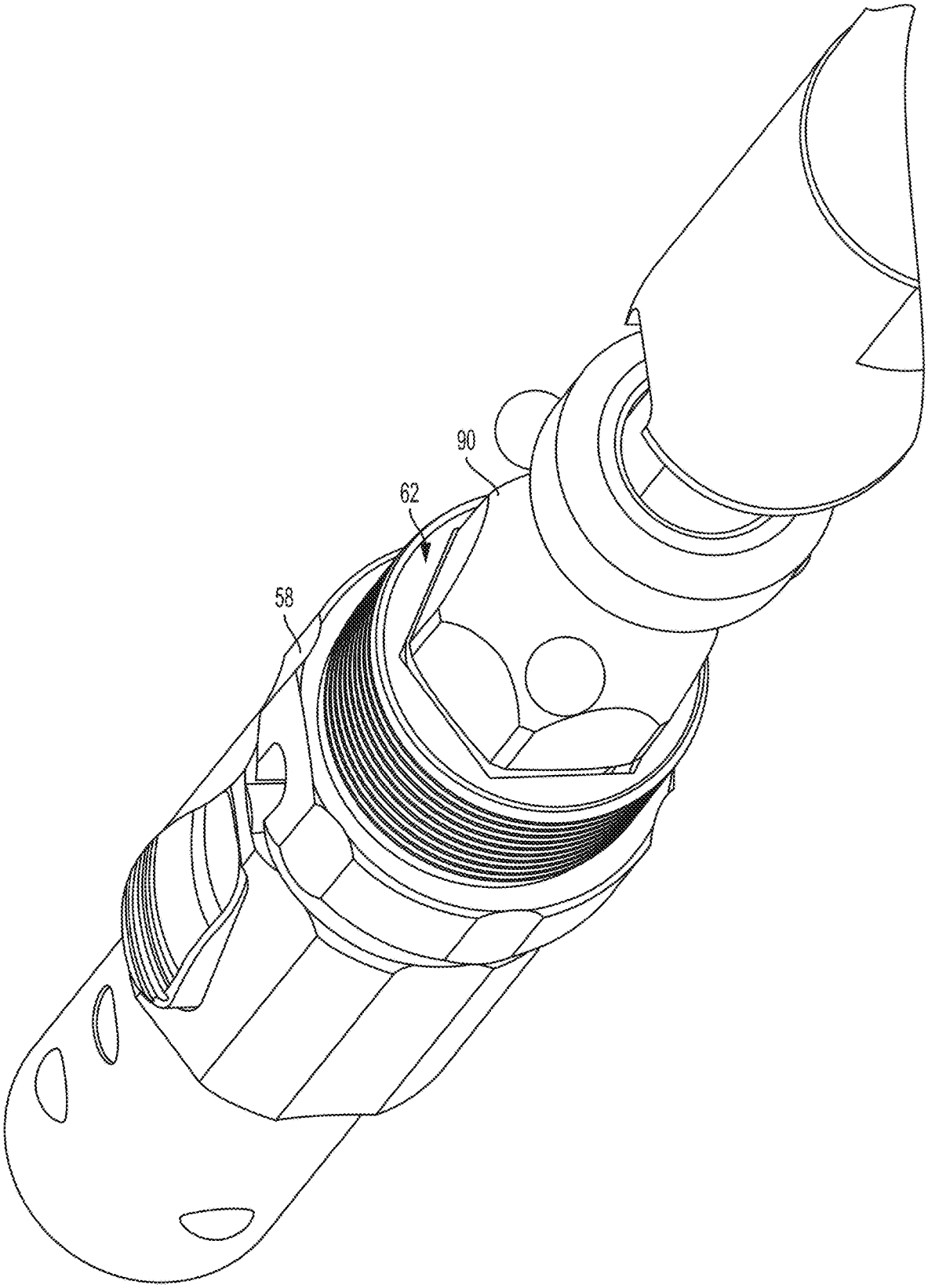
Figure 4C:
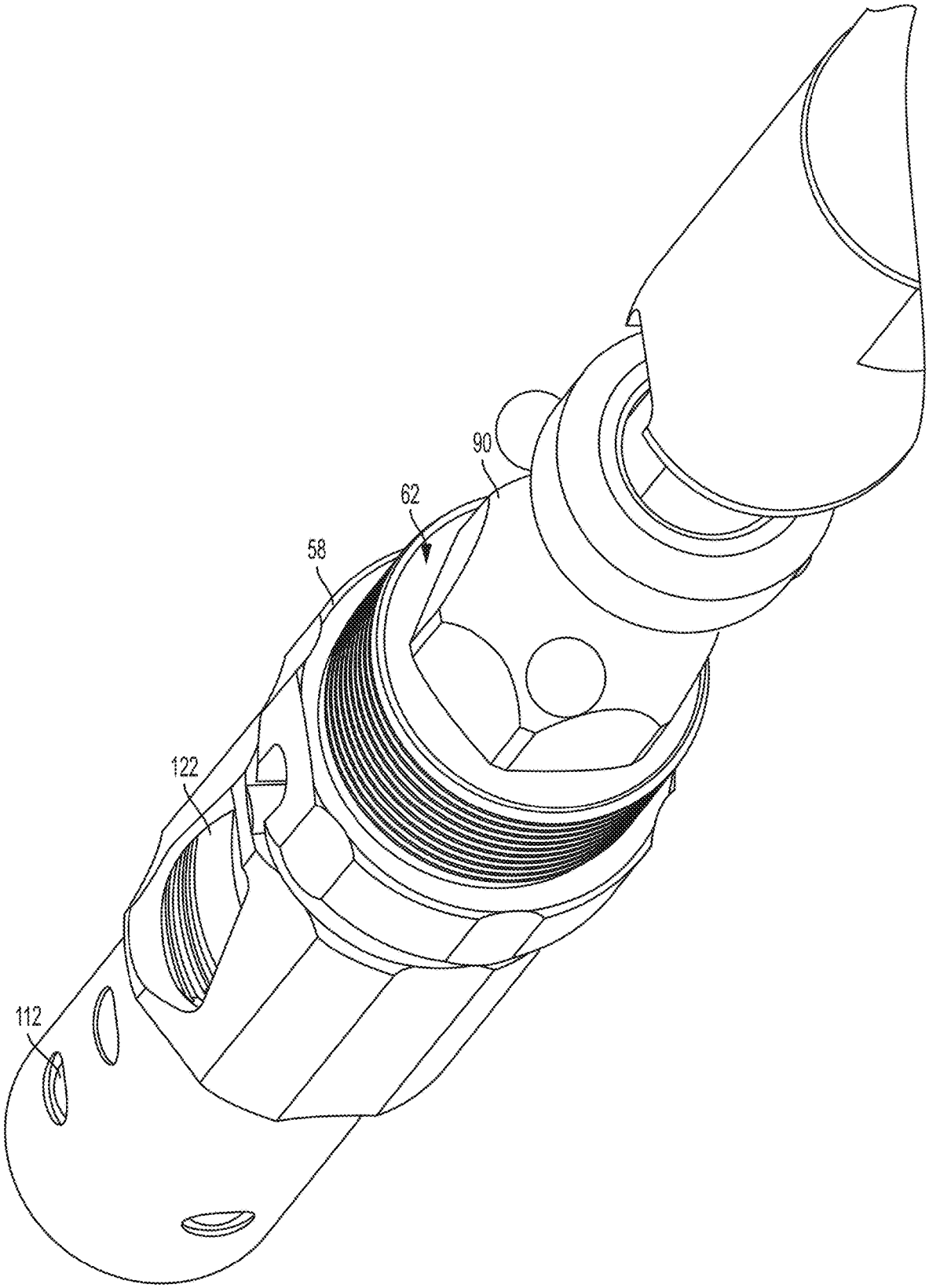

In use, the sleeve subassembly 50 can be configured for rotation about and between a locked position and an unlocked position. As shown in FIGS. 2A, 4A, and 5A, in the locked position, the drive element 90 can abut the first seat 62 defined by the sleeve subassembly 50, and the sleeve subassembly can be rotated about the common longitudinal axis 54. Optionally, with the sleeve subassembly 50 in the locked position, the engagement subassembly 100 can engage the drive element 90 to operatively couple the sleeve subassembly 50 to the drive element such that rotation of the sleeve subassembly affects a corresponding rotation of the drive element and the spindle 70. As shown in FIGS. 2B, 4B, and 5B, when the sleeve subassembly is positioned in the unlocked position, the sleeve subassembly 50 can be configured for axial advancement relative to the spindle 70. Optionally, with the sleeve subassembly 50 in the unlocked position, the drive element 90 and the spindle 70 can be configured for receipt within the distal portion of the central bore 52 of the sleeve subassembly 50, and the engagement subassembly 100 can be disengaged from the drive element 90. In exemplary aspects, when the sleeve subassembly 50 is positioned in the unlocked position, the drive element 90 and the spindle 70 can be configured for axial movement but not rotational movement relative to the common longitudinal axis 54. In exemplary aspects, and as shown in FIGS. 2A-2B and 4A-4C, the drive element 90 can have an outer surface that is radially inwardly tapered moving in a proximal direction relative to longitudinal axis 54. In these aspects, it is contemplated that the tapered profile of the drive element 90 can be configured to provide contact and engagement between the outer surface of the drive element and the engagement subassembly 100 when the sleeve subassembly 50 is positioned in the locked position and to disengage the outer surface of the drive element from the engagement subassembly when the sleeve subassembly is moved to the unlocked position. In exemplary aspects, when the sleeve subassembly 50 is positioned in the unlocked position, it is contemplated that the engagement subassembly 100 (e.g., engagement members 102) or a plurality of locking members 122 (as further disclosed herein) can drive the axial advancement of the sleeve subassembly 50 relative to the spindle 70.

In exemplary aspects, as shown in FIGS. 2A-5B and 8A-9A, the overshot assembly 10 can optionally comprise a latching assembly 110 operatively coupled to the distal body portion 30 and configured for movement about and between a retracted position and a deployed position. In these aspects, proximal axial advancement of the distal body portion 30 (and optionally, the sleeve subassembly 50) relative to the spindle 70 can be configured to effect movement of the latching assembly 110 from its deployed position toward its retracted position. More particularly, as the distal body portion 30 (and optionally, the sleeve subassembly 50) move in a proximal direction relative to the spindle 70, the distal body portion 30 drives movement of the latching assembly 110 in a proximal direction until the latching assembly is positioned at an axial position where the spindle 70 is shaped to accommodate the latching assembly within the central bore of the distal body portion. In additional aspects, as shown in FIGS. 2A-5B, the latching assembly 110 can optionally comprise at least one latch member 112 (optionally, a plurality of latch members 112). It is contemplated that each latch member 112 of the at least one latch member can be at least one of a ball, a roller, a cylinder, a cam-shaped element, and the like. As one of skill in the art will appreciate, unlike conventional latching mechanisms for drilling applications in which axial movement of a spindle positioned within a body is tied to axial movement of the body (i.e., axial movement of the body results in a corresponding axial movement of the spindle), the disclosed overshot assembly permits independent axial movement of the spindle and the distal body portion (and sleeve assembly, when present).

In further exemplary aspects, as shown in FIGS. 2A-5B, the overshot assembly 10 can optionally comprise a locking assembly 120 operatively coupled to the distal body portion 30 and configured for movement about and between a retracted position and a deployed position. In these aspects, when the sleeve subassembly 50 is positioned in the unlocked position, the locking assembly can be moved to its retracted position to drive axial movement of the sleeve assembly relative to the spindle 70. For example, it is contemplated that the locking assembly 120 can be manually positioned in the retracted position to drive axial movement of the sleeve assembly 50. In additional aspects, as shown in FIGS. 2A-5B, the locking assembly 110 can optionally comprise at least one locking member 122 (optionally, a plurality of locking members 122). Although disclosed herein as having an elongate body 124, it is contemplated that each locking member 122 of the at least one locking member can be at least one of a ball, a roller, a cylinder, a cam-shaped element, and the like. Optionally, the locking assembly 120 can be provided in combination with the latching assembly 110. However, in alternative aspects, the overshot assembly 10 can comprise only one of the latching assembly 110 and the locking assembly 120.

In exemplary aspects, the locking members 122 (e.g., locking members having an elongate body 124) can be configured for manual hand-pinching to position the locking members in a retracted position as described herein. In these aspects, it is contemplated that the locking members 122 can be spring-biased to the deployed position; thus, it is contemplated that the manual hand-pinching can overcome the spring bias force. In exemplary aspects, the locking members 122 can comprise at least one corrosion-resistant material, such as, for example and without limitation, hard metal, stainless steel, and the like.

Figure 9A:
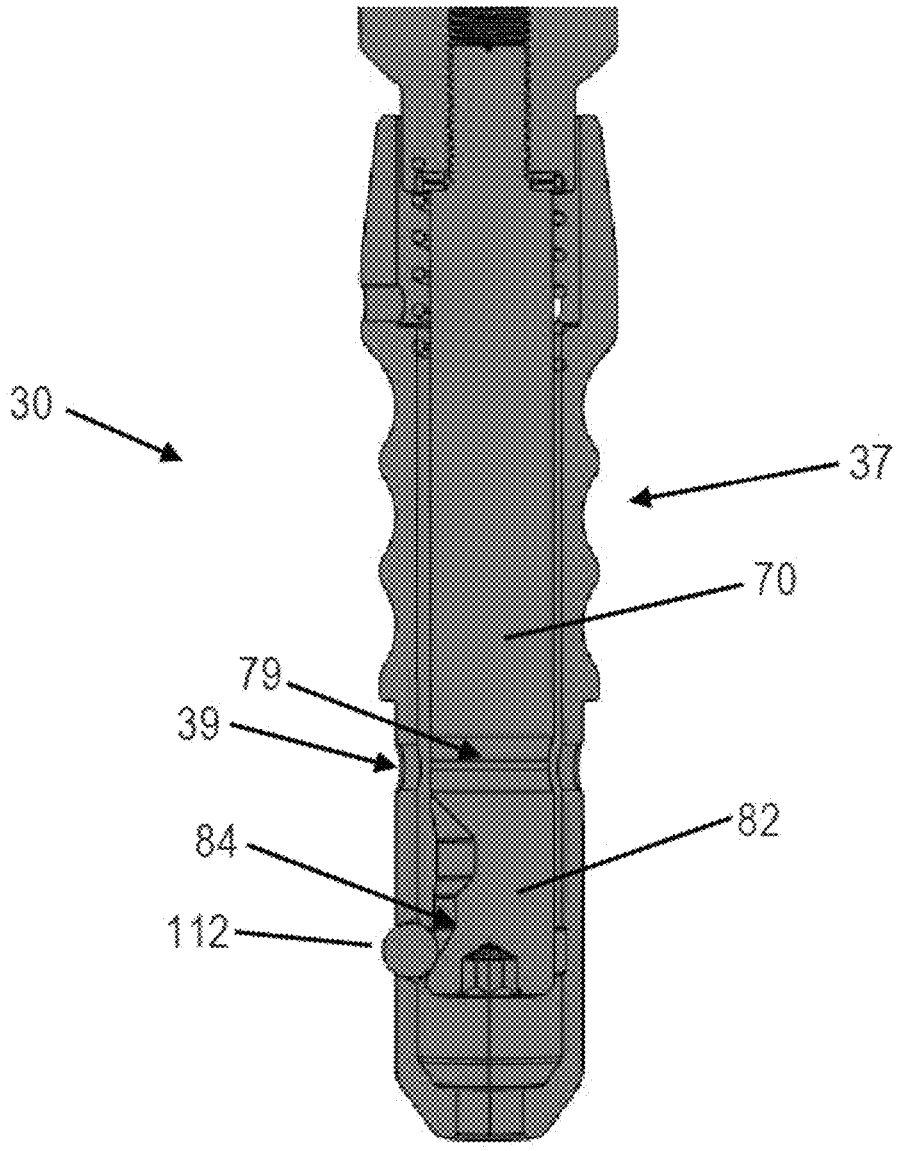
FIGS. 9A-9C depict an exemplary overshot assembly that includes a latch assembly but does not include a locking assembly, a sleeve assembly, or an engagement assembly as disclosed herein.
Figure 9B:
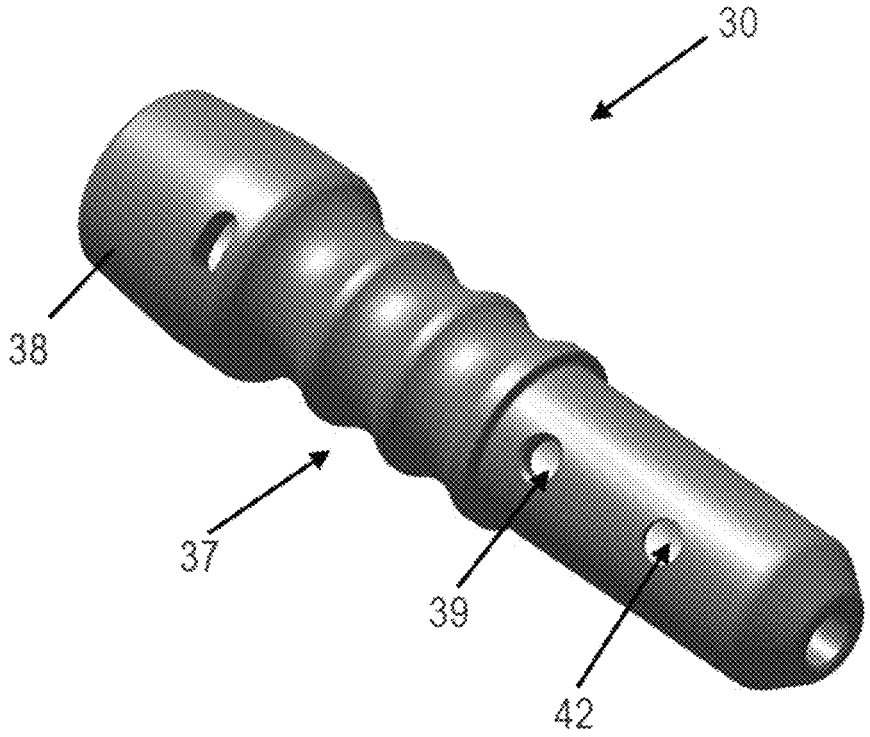
Figure 9C:
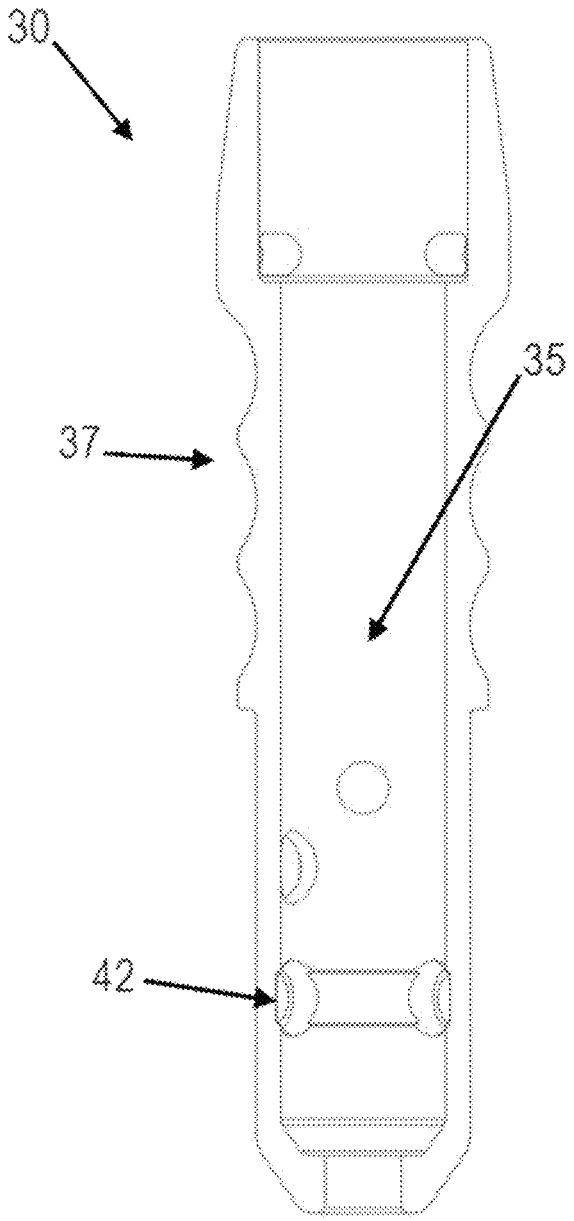

As shown in FIGS. 9A-9C, when the locking assembly 120 is omitted, it is contemplated that the outer surface 36 of the wall 32 of the distal body portion 30 (and, optionally, the sleeve subassembly when present) can define a grip portion 37 that is configured for complementary engagement by at least one hand of an operator or user of the overshot assembly 10. Optionally, in exemplary aspects, the grip portion 37 can comprise a plurality of radially projecting features that are spaced apart relative to the longitudinal axis of the distal body portion 30, with the axial spaces between sequential radially projecting features being configured to receive at least a portion of one or more fingers of a user of the overshot assembly 10. In use, it is contemplated that the grip portion 37 can allow a user of the overshot assembly to use his or her hands to securely engage the distal body portion 30 and effect twisting movement or proximal axial movement (optionally, twisting movement and proximal axial movement) of the distal body portion relative to the spindle 70 to thereby overcome biasing forces and move the latching assembly 110 from its deployed position to its retracted position as further disclosed herein.

In another aspect, the sleeve subassembly 50 can comprise a proximal sleeve portion 56 and a distal sleeve portion 58. Optionally, in this aspect, the proximal sleeve portion 56 and the distal sleeve portion 58 can be of unitary construction. Alternatively, it is contemplated that the proximal and distal sleeve portions 56, 58 can be separate components that are configured for secure attachment to each other by conventional means, such as, for example and without limitation, a threaded connection as depicted in FIGS. 2A-2B and 8A-8B. In an additional aspect, the distal sleeve portion 58 can be positioned between the proximal sleeve portion 56 and the distal body portion 30 relative to the common longitudinal axis 54. In this aspect, it is contemplated that the proximal and distal sleeve portions 56, 58 can respectively define the proximal and distal portions of the central bore 52 of the sleeve subassembly 50. In a further aspect, the distal sleeve portion 58 can have a proximal end 58 that defines the first seat 62 within the central bore 52 of the sleeve subassembly 50. In exemplary aspects, the central bore 52 of the sleeve subassembly 50 can be positioned in communication and substantial alignment with the central bore 35 of the distal body portion 30.

In additional aspects, the wall 32 of the distal body portion 30 can define at least one distal radial opening 42 extending from the outer surface 36 of the wall 32 to the central bore 35 of the distal body portion. In these aspects, the at least one distal radial opening 42 can be configured to at least partially receive the at least one latch member 112 when the latching assembly 110 is in the deployed position. Thus, in use, when the distal body portion 30 is axially advanced in a proximal direction relative to the spindle 70, the surfaces of the distal body portion 30 that define the at least one distal radial opening 42 can contact the at least one latch member 112 and apply an axial force to the at least one latch member until the at least one latch member is positioned at an axial location in which it can be received within the central bore 35 of the distal body portion 30.

In further aspects, when the overshot assembly 10 comprises a locking assembly 120, the wall 32 of the distal body portion 30 can also define at least one proximal radial opening 40 extending from the outer surface 36 of the wall to the central bore 35 of the distal body portion 30. In these aspects, the at least one proximal radial opening 40 can be configured to at least partially receive the at least one locking member 122 when the locking assembly 120 is in the deployed position.

In one aspect, the distal portion 76 of the spindle 70 can have a wedge portion 82. In this aspect, the wedge portion 82 of the distal portion 76 of the spindle 70 can define a first driving surface 84. In operation, the latching assembly 110 can be positioned in engagement with the first driving surface 84 when the latching assembly 110 is in the deployed position, and upon axial advancement of the distal body portion 30 relative to the longitudinal axis 54, a proximal portion of the first driving surface 84 can define a recess that is configured to receive the latching assembly and permit radial movement of the latching assembly toward the retracted position. Optionally, it is contemplated that the wedge portion 82 can be tapered inwardly moving in a proximal direction such that the latching assembly 110 is gradually and progressively received within the central bore of the distal body portion as the distal body portion and the latching assembly are axially advanced in a proximal direction.

Optionally, when the overshot assembly comprises a locking assembly 120, the distal portion 76 of the spindle 70 can have a recessed portion 78 that is spaced proximally from the wedge portion 82 relative to the common longitudinal axis 54. In this aspect, the distal portion 76 of the spindle 70 can comprise a second driving surface 80 that partially defines the recessed portion 78 and is radially inwardly tapered moving proximally relative to the common longitudinal axis 54. In operation, the locking assembly 120 can be positioned in engagement with the first driving surface 80 when the locking assembly is in the deployed position, and upon axial advancement of the distal body portion 30 (and optionally, the sleeve subassembly 50) relative to the longitudinal axis 54, the second driving surface 80 can be configured to disengage the locking assembly as the locking assembly 120 is driven axially in a proximal direction, thereby permitting receipt of the locking assembly within the recessed portion 78 and radial movement of the locking assembly toward the retracted position.

In an additional aspect, and with reference to FIGS. 2A-2B and 8A-8B, the distal sleeve portion 58 can have an inner surface 66 that defines a second seat 68 that projects radially inwardly relative to the common longitudinal axis 54. In this aspect, the second seat 68 can be spaced distally from the first seat 62 relative to the common longitudinal axis 54, and the second seat can be configured to abut the drive element 90 when the sleeve subassembly is positioned in the unlocked position and the drive element 90 is received within the proximal end of the distal sleeve portion as further disclosed herein.

In another aspect, as shown in FIGS. 2A-2B, 4A-4C, and 8A-8B, the drive element 90 can have a distal end 92 having a desired cross-sectional shape. In this aspect, the first seat 62 of the distal sleeve portion 58 can define a central opening 64 that has a shape that is complementary to the desired cross-sectional shape. In a further aspect, the central opening 64 can be configured to receive the distal end 92 of the drive element when the sleeve subassembly is positioned in the unlocked position. In operation, as shown in FIG. 4A, the distal end 92 of the drive element 90 is not oriented for receipt within the central opening 64 when the sleeve assembly 50 is positioned in the locked position. In exemplary aspects, the desired cross-sectional shape can be a substantially hexagonal cross-sectional shape. However, it is contemplated that any desired shape can be used, provided the sleeve assembly 50 can be moved about and between the locked position and the unlocked position as disclosed herein.

In further exemplary aspects, as shown in FIGS. 2A-2B and 8A-8B, at least a portion of the distal sleeve portion 58 of the sleeve subassembly 50 can be positioned within the central bore 35 of the distal body portion 30. Optionally, in these aspects, each locking member 122 of the at least one locking member 120 can have an elongate body 124, a proximal end portion 126, and an opposed distal end portion 128. In operation, a portion of the proximal end portion 126 of each locking member 122 can be positioned in engagement with the recessed portion 78 of the spindle 70, and a portion of the distal end portion 128 of each locking member 122 can be positioned in engagement with the second driving surface 80 when the at least one locking member is positioned in the deployed position. In exemplary aspects, and as shown in FIGS. 2A-2B, the proximal end portion 126 of each locking member 122 can comprise inner and outer projections 130, 132 that extend relative to the common longitudinal axis 54 to define a slot 134 positioned between the inner and outer projections. In these aspects, the slot 134 of each locking member 122 can at least partially receive the portion of the distal sleeve portion 58 of the sleeve subassembly 50 that is positioned within the central bore 35 of the distal body portion 30. In additional aspects, the inner projection 130 of each locking member 122 can be positioned in engagement with the recessed portion 78 of the spindle 70, and the outer projection 132 of each locking member 122 can be positioned in engagement with the wall 32 of the proximal end 38 of the distal body portion 30.

In additional aspects, and as further described herein and shown in FIGS. 2A-2B and 8A-8B, the wedge portion 82 of the distal portion 76 of the spindle 70 can define a first driving surface 84. In this aspect, the at least one latch member 112 can be positioned in engagement with the second driving surface 84 when the at least one latch member is positioned in the deployed position. Upon axial advancement of the distal body portion 30 (and optionally, the sleeve subassembly 50 when present) relative to the longitudinal axis 54, the second driving surface 84 can be configured to permit movement of the at least one latch member 112 toward the retracted position as further disclosed herein.

Thus, in exemplary aspects, when the overshot assembly 10 comprises both a latching assembly 110 and a locking assembly 120 as shown in FIGS. 2A-2B and disclosed herein, the second driving surface 80 can comprise a tapered, planar wedging surface that is configured to mate against two manually hand-pinched locking members as disclosed herein, while the first driving surface 84 can comprise a tapered, planar wedging surface that is configured to mate against latching members that are selectively retracted by proximal movement of the distal body portion 30 as disclosed herein. In exemplary aspects, it is contemplated the locking members can be manually pinched into their retracted positions without the need for twisting action. In further exemplary aspects, it is contemplated that the first and second driving surfaces 80, 84 can be formed by milling pathways for each respective latching and locking member 112, 122. In these aspects, it is contemplated that the milling of such pathways can increase the strength of the spindle 70 and of the driving force applied by the driving surfaces.

In further aspects, and as shown in FIGS. 2A-2B and 8A-8B, the proximal portion 74 of the spindle 70 can be pivotally coupled to the proximal body portion 20. In these aspects, the proximal body portion 20 can define a central bore 22, and the overshot assembly 10 can further comprise a ball joint 140 received within the central bore 22 of the proximal body portion 20. In an additional aspect, the overshot assembly 10 can further comprise a pivot joint element 150 secured to the proximal portion 74 of the spindle 70 and at least partially received within the central bore 22 of the proximal body portion 20. In this aspect, the pivot joint element 150 can be configured for pivotal movement relative to the ball joint 140 within the central bore 22 of the proximal body portion 20. In still further aspects, the overshot assembly 10 can further comprise a proximal spring 160 positioned within the central bore 22 of the proximal body portion 20 in substantial alignment with the common longitudinal axis 54. In these aspects, the proximal spring 160 can be positioned in engagement with the ball joint 140. In still further aspects, the overshot assembly 10 can further comprise a distal spring 170 positioned within the central bore 35 of the distal body portion 30 in substantial alignment with the common longitudinal axis 54. In these aspects, the distal spring 170 can be positioned between and in engagement with a distal portion of the wall 32 of the distal body portion 30 and the distal portion 76 of the spindle 70.

In exemplary aspects, it is contemplated that the distal body portion 30 (and sleeve subassembly 50, when present) of the overshot 10 can be configured for pivotal movement in at least two planes relative to the proximal body portion 20 of the overshot. In further exemplary aspects, it is contemplated that the distal body portion 30 (and sleeve subassembly 50, when present) of the overshot 10 can be configured for pivotal movement in three perpendicular planes relative to the proximal body portion 20 of the overshot.

In use, proximal spring 160 can provide a bias to create pivot detent positioning in which the overshot assembly 10 can be selectively maintained in a selected angular position. In one exemplary aspect, the selected angular position can correspond to a straight position that can be used for tripping through drill strings. In another exemplary aspect, it is contemplated that the selected angular position can correspond to an angled position, such as, for example and without limitation, a pivoted, kinked, and/or knuckled orientation that allows for manual handling of the assembly outside of the drill string when operating in confined spaces, and to manage the awkward additional length of the inner tube assembly, and the tension/weight of the wireline cable, which are mated at opposite ends of the overshot assembly.

In use, spring 170 can provide a relatively weak axial bias for the spindle 70 during assembly, relative to the distal body 36, such that each latch member 112 can be easily progressively installed and retained. Additionally, in operation, spring 170 can cooperate with a primary (stronger) latch spring that biases the latching assembly 110 to its deployed position as disclosed herein. Optionally, when the overshot assembly 10 comprises a sleeve assembly 50 and a drive element 90, the latch spring can be positioned between and in engagement with the sleeve assembly 50 and the drive element 90. When the overshot assembly 10 comprises an engagement assembly 100 and a locking assembly 120 (in addition to the latch assembly 110), it is contemplated that the primary (stronger) latch spring can be configured to bias the engagement assembly 100, the latch assembly 110, and the locking assembly 120 to their default deployed positions as further disclosed herein.

Upon movement of the distal body portion 30 (and optionally, sleeve subassembly 50, when present) in a distal direction substantially parallel to the longitudinal axis 54, it is contemplated that the first driving surface 84 of the wedge portion 82 can be configured to wedge the at least one latch member 112 between the inner surface of the head assembly 300 and the second driving surface 84. Thus, it is contemplated that the inner surface of the head assembly 300 can be configured for secure engagement with the at least one latch member 112 of the overshot assembly 10 when the at least one latch member is positioned in the deployed position. Upon secure engagement between the at least one latch member 112 of the overshot assembly 110 and the inner surface of the head assembly 300 as described herein, it is contemplated that the head assembly 300 can be operatively coupled to the overshot such that movement of the overshot results in a corresponding movement of the head assembly. For example, following secure engagement between the at least one latch member 112 and the inner surface of the head assembly 300, it is contemplated that movement of the overshot assembly 10 in one or more directions sufficient to exit a drilling formation can cause movement of the head assembly in the same directions such that the overshot and the head assembly can be removed from the drilling formation. Optionally, it is contemplated that the at least one latch member 112 of the overshot assembly 10 can securely engage the inner surface of the head assembly such that the overshot assembly cannot rotate relative to the head assembly.

In additional aspects, when the at least one latch member 112 of the overshot is positioned in the retracted position, it is contemplated that the at least one latch member and the outer surface of the wall of the distal body portion 30 can define an outer diameter of the distal body portion of the overshot assembly 10 that is less than the inner diameter of the head assembly. In further aspects, and as further disclosed herein, it is contemplated that the at least one latch member 112 can be biased toward the deployed position. In exemplary aspects, the at least one latch member 112 can be spring-loaded toward the deployed position. In these aspects, it is contemplated that the spindle 70 (and the drive element 90, when present) can be spring-loaded toward an axial position in which the at least one latch member 112 is urged toward the deployed position (by wedge portion 82). Upon entry of the distal body portion 30 of the overshot 10 into the opening and central bore of the head assembly, it is contemplated that the inner surface of the retracting case and/or the proximal end of the head assembly can be configured to force the at least one latch member 112 into the retracted position (from the deployed position) to accommodate the distal body portion of the overshot within the head assembly. In further exemplary aspects, the at least one groove can be configured to securely receive the at least one latch member 112 of the overshot 10 when the at least one latch member is positioned in the deployed position. In still further exemplary aspects, it is contemplated that the proximal end of the head assembly can be configured to abut a portion of the overshot 10 when the at least one latch member 112 is received within the at least one groove of the retracting case.

Upon movement of the distal body portion (and, optionally, drive element 90 when present) in a proximal direction (opposed to the first, distal direction) and substantially parallel to the longitudinal axis 54 (such that the first driving surface 84 of the wedge portion 82 is disengaged from the at least one latch member 112), the at least one latch member 112 can be retracted relative to the inner surface of the head assembly such that the at least one latch member disengages the inner surface of the head assembly.

In use, and with reference to FIGS. 2A-2B and 4A-5B, it is contemplated that the recessed portion 78, the wedge portion 82, and the latching and locking members 112, 122 can be configured and positioned such that when the axial movement of the distal body portion 30 relative to the spindle 70 effects positioning of the latching members 112 in the deployed position, the movement of the distal body portion (and the sleeve assembly 50, when present) can effect positioning of the locking members 122 in the deployed position. Similarly, it is contemplated that the recessed portion 78, the wedge portion 82, and the latching and locking members 112, 122 can be configured and positioned such that when the distal body portion 30 is advanced longitudinally such that the latching members return to the retracted position, the locking members 122 will also be returned to the retracted position. It is contemplated that the latching members 112 can be sized to protrude beyond the wall 32 of the distal body portion 30 and securely engage the inner surface of the head assembly while maintaining secure engagement with the distal body portion of the overshot assembly 10. Thus, it is contemplated that, upon engagement between the latching members 112 and the inner surface of the head assembly, the latching members (and the head assembly) can be configured to support loads applied by the overshot assembly 10. In operation, it is contemplated that the recessed portion 78 and the wedge portion 82 can be sized and shaped to accommodate radial and axial movement of the latching and locking members 112, 122 as described herein.

Figure 8A:
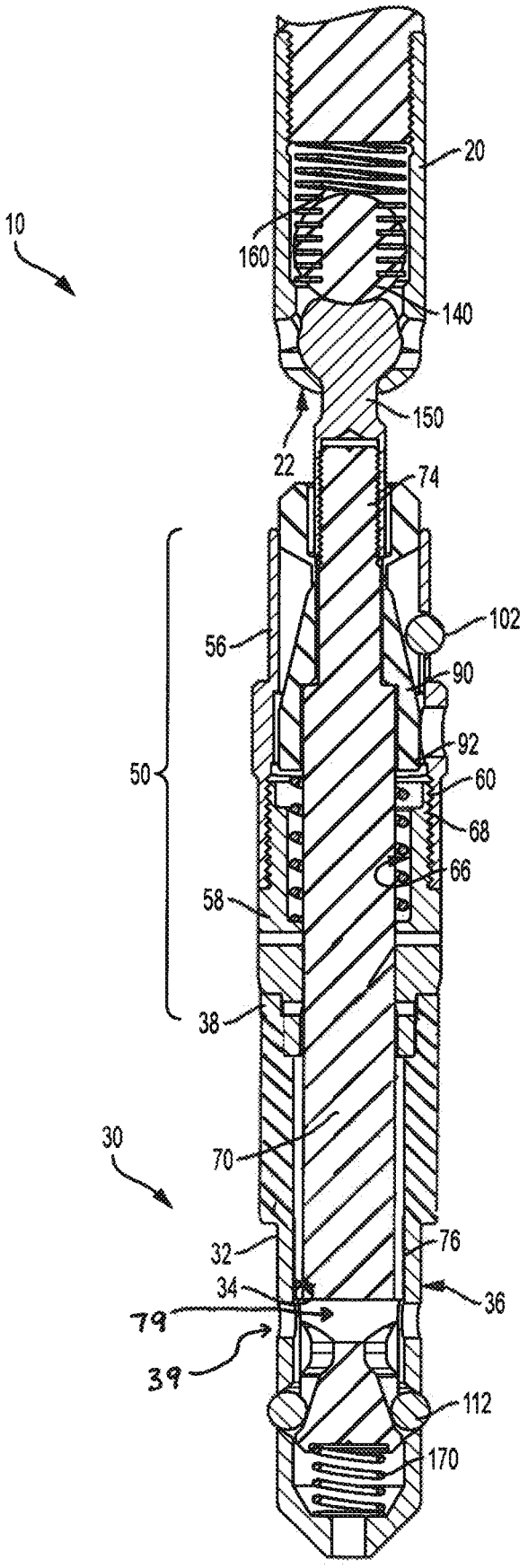
FIGS. 8A-8B are front cross-sectional views of an exemplary overshot assembly that has a latch assembly but does not have a locking assembly as disclosed herein.
Figure 8B:
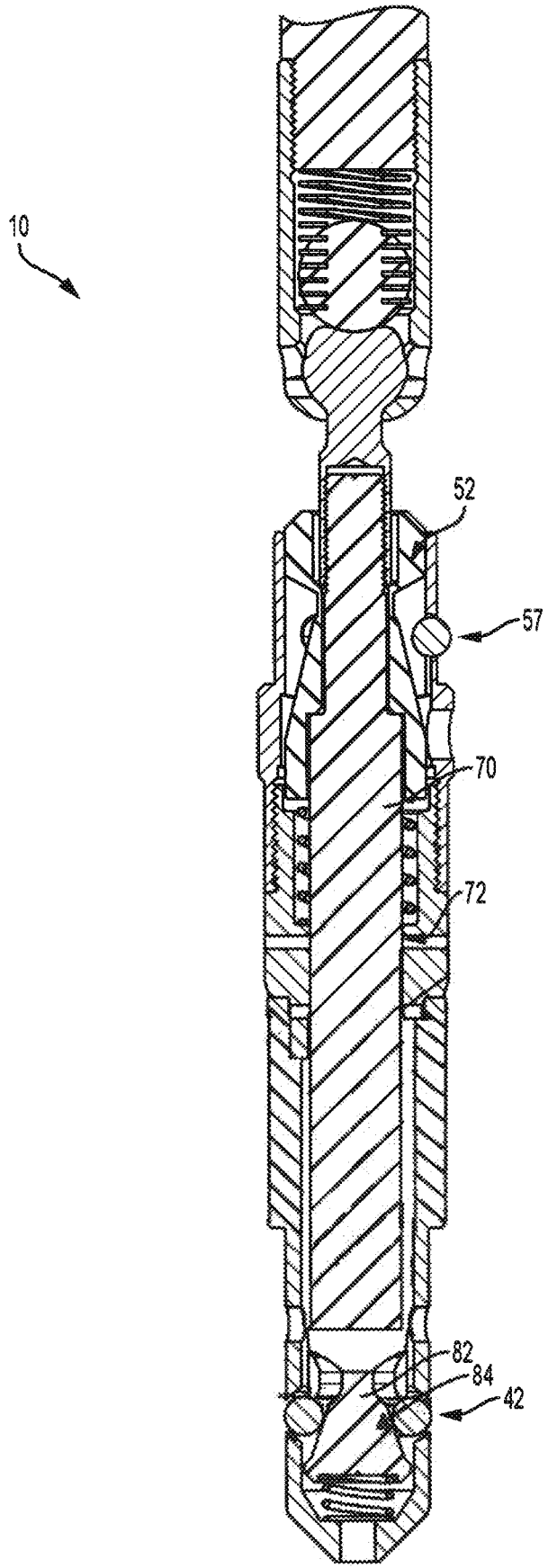

Optionally, in exemplary aspects, and as shown in FIGS. 8A and 9A, the wall 32 of the distal body portion 30 and the spindle 70 can define respective transverse bores 39, 79 that can be aligned when the latch assembly is in the deployed position. In these aspects, it is contemplated that when the latch assembly is in the deployed position, a locking pin (not shown) can be inserted through the aligned transverse bores 39, 79 of the distal body portion 30 and the spindle 70 to restrict axial movement of the distal body portion relative to the spindle and thereby retain the latch assembly in the deployed position. It is further contemplated that the head assembly 300 can define its own transverse bores (e.g., two transverse bores on opposing sides of the head assembly) that are positioned to align with the transverse bores of the distal body portion 30 and the spindle 70 when the latch assembly is positioned in engagement with the head assembly as further disclosed herein (e.g., when the latch assembly engages a groove within the head assembly). In use, it is contemplated that the locking pin can pass through the aligned transverse bores of the distal body portion 30, the spindle 70, and the head assembly 300 to lock the relative axial positions of these components. It is further contemplated that the locking pin can function as a safety feature during handling of the overshot and mated head assembly (including an inner tube) outside of the drilled hole. During manual or automated handling outside of the hole, the locking pin can be configured to prevent the accidental release of the head assembly in response to sufficient inertia, bumping, or impact.

Figure 7:
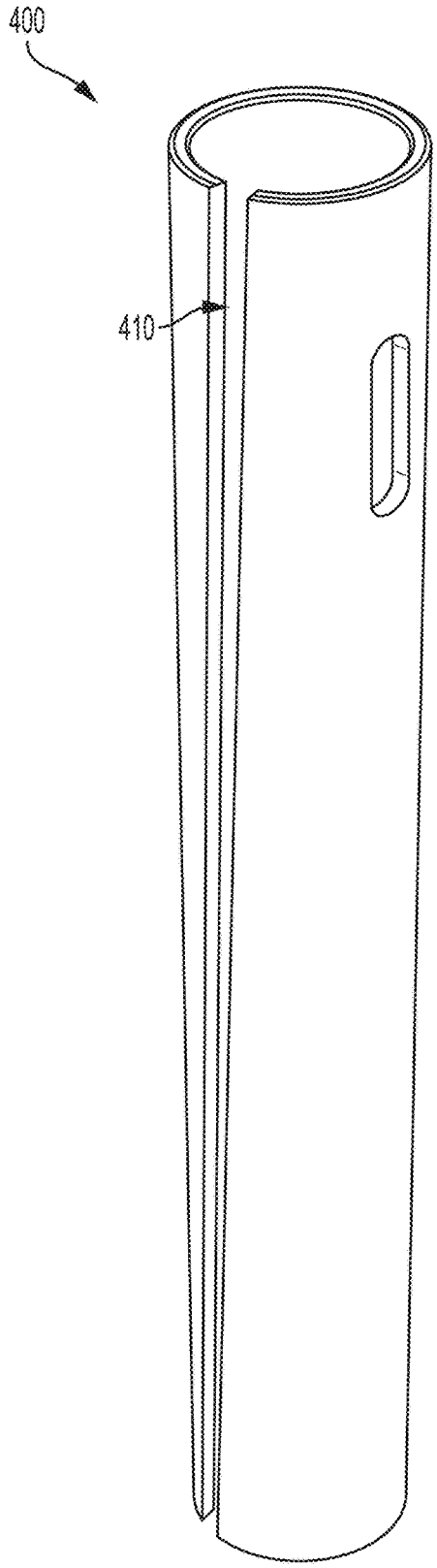
FIG. 7 depicts an exemplary release sleeve as disclosed herein.

Optionally, as shown in FIG. 7, it is contemplated that the head assembly 300 can comprise a release mechanism that permits release of a core barrel in the event the core barrel becomes stuck and/or jammed during drilling operations. In exemplary aspects, the release mechanism can comprise a release sleeve 400 defining a longitudinal slot 410. In these aspects, it is contemplated that a portion of the wireline cable can be passed through the slot 410 of the release sleeve 400 such that the release sleeve substantially circumferentially surrounds the wireline cable. From this position, it is contemplated that the release sleeve 400 can be axially advanced toward the engagement subassembly 100 (e.g., the plurality of engagement members 102) until the sleeve lands on the outermost edges of the engagement members (with the engagement members positioned in the deployed position). It is further contemplated that, due to the weight of the release sleeve 400, the release sleeve can continue its axial movement relative to the common longitudinal axis 54 (and away from the proximal body portion 20) until the release sleeve effects inward radial movement of the engagement subassembly 100 toward its retracted position and passes over the engagement subassembly (e.g., engagement members). In use, and as further disclosed herein, it is contemplated that the downward impact and weight of the dropped release sleeve 400 against the engagement subassembly 100 can be configured to axially lift the distal sleeve subassembly 50 relative to the spindle 70 and the drive element 90.

In use, it is contemplated that when the overshot 10 is fully seated within a core barrel assembly as disclosed herein, the overshot can be axially advanced such that the latching and/or locking members 112, 122 are positioned in their retracted (un-latched and/or un-locked) positions. As used herein, the term "fully seated" refers to a position in which there is substantially no wireline cable retraction tension and the overshot 10 is seated by gravity alone or by pump-in fluid pressure alone, thereby permitting the latch members 112 to be driven into their retracted/un-latched position. Once wireline retraction begins, the overshot 10 is lifted slightly, and the latch members 112 are substantially adjacent to a latch groove in the retracting case, it is contemplated that the latch members can be returned by a spring load into their default deployed/latched position.

It is contemplated that the engagement members 102 can be operatively coupled to the latching and/or locking members 112, 122 through the drive element 70 such that the engagement members are positioned in a deployed position (for example, a radially extended position relative to the longitudinal axis 54) when the latching and/or locking members 112, 122 are positioned in a latched or locked position. It is further contemplated that the engagement members 102 can be operatively coupled to the latching and/or locking members 112, 122 such that, upon retraction of the engagement members, the latching and/or locking members 112, 122 are likewise radially retracted toward their respective retracted positions. It is still further contemplated that retraction of the engagement members 102, latching members 112, and/or locking members 122 can be configured to permit release of a core barrel. It is further contemplated that, after the release sleeve 400 is passed over the engagement subassembly 100 as disclosed herein, the release sleeve can remain positioned such that the engagement subassembly is incapable of outward radial movement toward the deployed position while the overshot assembly 10 is lifted out of the core barrel assembly 300.

In use, it is contemplated that the sleeve subassembly can permit one-handed manual locking of the drive element 90 relative to the longitudinal axis 54. It is further contemplated that such one-handed manual locking can be used to position the at least one locking member 122 in the locked position and to position the at least one latch member 112 in the latched position prior to extraction of the overshot assembly 10 from the head assembly 300. However, it is contemplated that the at least one locking member 122 can be manually locked in other situations depending upon the particular application (e.g. locking prior to tripping of survey instrumentation without drilling). In some aspects, the latching members 112 and/or locking members 122 can protrude only a limited distance from the distal body portion 30. In these aspects, given the tight radial fits required for operation of the latching and locking members 112, 122 as described herein, it is contemplated that the latching members, locking members, the distal body portion 30, and/or the head assembly can comprise corrosion and/or wear-resistant materials and/or be treated with corrosion and/or wear-resistant coatings or treatments.

As further described herein, it is contemplated that the overshot assemblies 10 disclosed herein can comprise various combinations of the previously described components. For example, in some exemplary aspects, and with reference to FIGS. 9A-9C, it is contemplated that the overshot assembly can comprise a proximal body portion, a distal body portion, a spindle, and a latch assembly without the need for providing a sleeve assembly, a drive element, an engagement assembly, or a locking assembly as disclosed herein. In these aspects, it is contemplated that the distal body portion can be configured for (1) twisting movement relative to the spindle and then (2) axial movement relative to the spindle to overcome a spring-biasing force (that drives the spindle into an axial position in which the latching assembly is forced to the deployed position), thereby axially displacing the latching assembly such that it can be received in the retracted position. It is further contemplated that the recessed portion 78 of the spindle can be eliminated and optionally modified such that the spindle has a substantially consistent outer diameter within the distal body portion. It is further contemplated that the distal body portion can define a grip portion 37 as further disclosed herein to promote twisting or axial movement of the distal body portion relative to the spindle. It is still further contemplated that, by providing more effective axial displacement of the distal body portion relative to the spindle, the grip portion 37 disclosed herein can allow for use of a stronger and more reliable spring to bias the latching assembly to the deployed position, thereby making the overshot assembly safer and more reliable.

It is contemplated that, by eliminating the spearhead assembly required in conventional overshot systems, the disclosed overshot assembly 10 and head assembly (and retracting case, if provided) can comprise more robust and reliable materials than conventional overshot systems. Moreover, the investment castings and elongated geometries conventionally used in the components of overshot systems are associated with large dimensional variance, rough surfaces, mechanical property variance, material flaws, inclusion of foreign materials, and heat treatment limitations. Through the elimination of these investment castings and associated elongated geometries, it is contemplated that the disclosed overshot assembly 10 and head assembly can comprise machined and/or formed materials having reduced dimensional variance, thereby permitting tighter fits (due to more accurate production mechanisms) and a greater range of material properties and surface treatments. It is further contemplated that, with the elimination of the spearhead assembly, the disclosed overshot assembly 10 and overshot system 200 can provide a more compact design with a smaller number of parts, thereby ensuring improved reliability.

It is further contemplated that the elimination of a twist sleeve that surrounds the shaft of an overshot assembly can eliminate the risk of intermediary corrosion and/or seizing in the disclosed overshot assembly.

It is still further contemplated that the milling of pathways and wedge-ramps in the spindle 70 for engagement with the latching and locking members 112, 122 can provide increased strength in comparison to turned conical wedges and other known approaches for producing driving surfaces.

EXEMPLARY ASPECTS

In view of the described devices, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: An overshot assembly comprising: a proximal body portion; a distal body portion having a wall, the wall of the distal body portion having an inner surface, an outer surface, and a proximal end, the inner surface of the wall of the distal body portion defining a central bore of the distal body portion, a sleeve subassembly having a central bore and a common longitudinal axis with the distal body portion, wherein the central bore of the sleeve subassembly has proximal and distal portions, and wherein the sleeve subassembly defines a first seat within the central bore of the sleeve subassembly; a spindle at least partially received within the central bores of the sleeve subassembly and the distal body portion, wherein the spindle has an outer surface, a proximal portion, and a distal portion; a drive element secured to the proximal portion of the spindle; an engagement subassembly operatively coupled to the sleeve subassembly and projecting radially inwardly within the central bore of the sleeve subassembly; and a latching assembly operatively coupled to the distal body portion and configured for movement about and between a retracted position and a deployed position, wherein the sleeve subassembly is configured for rotation about and between a locked position and an unlocked position, wherein in the locked position, the drive element abuts the first seat defined by the sleeve subassembly, wherein in the unlocked position, the sleeve subassembly is configured for axial advancement relative to the spindle and the drive element and the spindle are configured for axial movement but not rotational movement relative to the common longitudinal axis, and wherein axial advancement of the sleeve subassembly relative to the spindle is configured to effect movement of the latching assembly from its deployed position toward its retracted position.

Aspect 2: The overshot assembly of aspect 1, wherein the sleeve subassembly comprises a proximal sleeve portion and a distal sleeve portion, wherein the distal sleeve portion is positioned between the proximal sleeve portion and the distal body portion relative to the common longitudinal axis, wherein the proximal and distal sleeve portions respectively define the proximal and distal portions of the central bore of the sleeve subassembly, and wherein the distal sleeve portion has a proximal end that defines the first seat within the central bore of the sleeve subassembly.

Aspect 3: The overshot assembly of aspect 2, wherein the central bore of the sleeve subassembly is positioned in communication and substantial alignment with the central bore of the distal body portion, and wherein at least a portion of the distal sleeve portion of the sleeve subassembly is positioned within the central bore of the distal body portion.

Aspect 4: The overshot assembly of aspect 3, further comprising a locking assembly operatively coupled to the distal body portion and configured for movement about and between a retracted position and a deployed position, wherein the locking assembly is positioned between the sleeve subassembly and the latching assembly relative to the common longitudinal axis, and wherein when the sleeve subassembly is positioned in the unlocked position, movement of the locking assembly from the deployed position to the retracted position is configured to drive axial advancement of the sleeve relative to the spindle.

Aspect 5: The overshot assembly of aspect 4, wherein the latching assembly comprises at least one latch member, and wherein the locking assembly comprises at least one locking member.

Aspect 6: The overshot assembly of aspect 5, wherein the wall of the distal body portion defines at least one proximal radial opening extending from the outer surface of the wall to the central bore of the distal body portion and at least one distal radial opening extending from the outer surface of the wall to the central bore of the distal body portion, wherein the at least one proximal radial opening is configured to at least partially receive the at least one locking member when the locking assembly is in the deployed position, and wherein the at least one distal radial opening is configured to at least partially receive the at least one latch member when the latching assembly is in the deployed position.

Aspect 7: The overshot assembly of aspect 4, wherein the distal portion of the spindle has a recessed portion and a wedge portion spaced distally from the recessed portion relative to the common longitudinal axis, wherein the distal portion of the spindle comprises a first driving surface that partially defines the recessed portion and is radially inwardly tapered moving proximally relative to the common longitudinal axis, wherein the locking assembly is positioned in engagement with the first driving surface when the locking assembly is in the deployed position, and wherein upon axial advancement of the sleeve subassembly relative to the longitudinal axis, the first driving surface is configured to disengage the locking assembly to permit movement of the locking assembly toward the retracted position.

Aspect 8: The overshot assembly of aspect 7, wherein the wedge portion of the distal portion of the spindle defines a second driving surface, wherein the latching assembly is positioned in engagement with the second driving surface when the latching assembly is in the deployed position, and wherein upon axial advancement of the sleeve subassembly relative to the longitudinal axis, the second driving surface is configured to permit movement of the latching assembly toward the retracted position.

Aspect 9: The overshot assembly of any one of aspects 2-8, wherein when the sleeve subassembly is in the locked position, the engagement subassembly engages the drive element to operatively couple the sleeve subassembly to the drive element such that rotation of the sleeve subassembly effects a corresponding rotation of the drive element and the spindle, and wherein when the sleeve subassembly is in the unlocked position, the engagement subassembly is disengaged from the drive element and the drive element is configured for receipt within the distal portion of the central bore of the sleeve subassembly.

Aspect 10. The overshot assembly of any one of aspects 2-9, wherein the distal sleeve portion has an inner surface that defines a second seat that projects radially inwardly relative to the common longitudinal axis, wherein the second seat is spaced distally from the first seat relative to the common longitudinal axis, and wherein the second seat is configured to engage the drive element to limit axial movement of the drive element and the spindle when the sleeve subassembly is positioned in the unlocked position.

Aspect 11: The overshot assembly of any one of aspects 2-10, wherein the drive element has a distal end having a desired cross-sectional shape, and wherein the first seat of the distal sleeve portion defines a central opening that has a shape that is complementary to the desired cross-sectional shape.

Aspect 12: The overshot assembly of aspect 11, wherein the central opening is configured to receive the distal end of the drive element when the sleeve subassembly is positioned in the unlocked position, and wherein the distal end of the drive element is not oriented for receipt within the central opening when the drive element is positioned in the locked position.

Aspect 13: The overshot assembly of aspect 12, wherein the desired cross-sectional shape is a substantially hexagonal cross-sectional shape.

Aspect 14: The overshot assembly of aspect 6, wherein the distal portion of the spindle has a recessed portion and a wedge portion spaced distally from the recessed portion relative to the common longitudinal axis, wherein the distal portion of the spindle comprises a first driving surface that partially defines the recessed portion and is radially inwardly tapered moving proximally relative to the common longitudinal axis, wherein the at least one locking member is positioned in engagement with the first driving surface when the at least one locking member is positioned in the deployed position, and wherein upon axial advancement of the sleeve subassembly relative to the longitudinal axis, the first driving surface is configured to permit movement of the at least one locking member toward the retracted position.

Aspect 15: The overshot assembly of aspect 14, wherein each locking member of the at least one locking member has an elongate body, a proximal end portion, and an opposed distal end portion, wherein a portion of the proximal end portion of each locking member is positioned in engagement with the recessed portion of the spindle, and wherein a portion of the distal end portion of each locking member is positioned in engagement with the first driving surface when the at least one locking member is positioned in the deployed position.

Aspect 16: The overshot assembly of aspect 15, wherein the proximal end portion of each locking member comprises inner and outer projections that define a slot, and wherein the slot of each locking member at least partially receives the portion of the distal sleeve portion of the sleeve subassembly that is positioned within the central bore of the distal body portion.

Aspect 17: The overshot assembly of aspect 16, wherein the inner projection of each locking member is positioned in engagement with the recessed portion of the spindle, and wherein the outer projection of each locking member is positioned in engagement with the wall of the proximal end of the distal body portion.

Aspect 18: The overshot assembly of any one of aspects 14-17, wherein the wedge portion of the distal portion of the spindle defines a second driving surface, wherein the at least one latch member is positioned in engagement with the second driving surface when the at least one latch member is positioned in the deployed position, and wherein upon axial advancement of the sleeve subassembly relative to the longitudinal axis, the second driving surface is configured to permit movement of the at least one latch member toward the retracted position.

Aspect 19: The overshot assembly of any one of aspects 2-18, wherein the spindle is pivotally coupled to the proximal body portion, Aspect 20: The overshot assembly of aspect 19, wherein the proximal body portion defines a central bore, and wherein the overshot assembly further comprises: a ball joint received within the central bore of the proximal body portion; and a pivot joint element secured to the proximal portion of the spindle and at least partially received within the central bore of the proximal body portion, wherein the pivot joint element is configured for pivotal movement relative to the ball joint within the central bore of the proximal body portion.

Aspect 21: The overshot assembly of aspect 20, further comprising: a proximal spring positioned within the central bore of the proximal body portion in substantial alignment with the common longitudinal axis, wherein the proximal spring is positioned in engagement with the ball joint.

Aspect 22: The overshot assembly of aspect 21, further comprising: a distal spring positioned within the central bore of the distal body portion in substantial alignment with the common longitudinal axis, wherein the distal spring is positioned between and in engagement with the wall of the distal body portion and the distal portion of the spindle.

Aspect 23: An overshot assembly comprising: a proximal body portion; a distal body portion having a wall, the wall of the distal body portion having an inner surface, an outer surface, and a proximal end, the inner surface of the wall of the distal body portion defining a central bore of the distal body portion, a sleeve subassembly having a central bore and a common longitudinal axis with the distal body portion, wherein the central bore of the sleeve subassembly has proximal and distal portions, and wherein the sleeve subassembly defines a first seat within the central bore of the sleeve subassembly; a spindle at least partially received within the central bores of the sleeve subassembly and the distal body portion, wherein the spindle has an outer surface, a proximal portion, and a distal portion; a drive element secured to the proximal portion of the spindle; and an engagement subassembly operatively coupled to the sleeve subassembly and projecting radially inwardly within the central bore of the sleeve subassembly, wherein the sleeve subassembly is configured for rotation about and between a locked position and an unlocked position, wherein in the locked position, the drive element abuts the first seat defined by the sleeve subassembly, and wherein in the unlocked position, the sleeve subassembly is configured for axial advancement relative to the spindle and the drive element and the spindle are configured for axial movement but not rotational movement relative to the common longitudinal axis.

Aspect 24: The overshot assembly of aspect 23, further comprising a latching assembly operatively coupled to the distal body portion and configured for movement about and between a retracted position and a deployed position, wherein axial advancement of the sleeve subassembly relative to the spindle is configured to effect movement of the latching assembly from its deployed position toward its retracted position.

Aspect 25: The overshot assembly of aspect 23 or aspect 24, further comprising a locking assembly operatively coupled to the distal body portion and configured for movement about and between a retracted position and a deployed position, wherein when the sleeve subassembly is positioned in the unlocked position, movement of the locking assembly from the deployed position to the retracted position is configured to drive axial advancement of the sleeve relative to the spindle.

Aspect 26: The overshot assembly of aspect 24 or aspect 25, further comprising a locking assembly operatively coupled to the distal body portion and configured for movement about and between a retracted position and a deployed position, wherein the locking assembly is positioned between the sleeve subassembly and the latching assembly relative to the common longitudinal axis, and wherein when the sleeve subassembly is positioned in the unlocked position, movement of the locking assembly from the deployed position to the retracted position is configured to drive axial advancement of the sleeve relative to the spindle.

Aspect 27: An overshot system comprising an overshot assembly as disclosed herein.

Aspect 28. A method of using the overshot assembly of any one of aspects 1-22.

Aspect 29: A method of using the overshot assembly of any one of aspects 23-26.

Aspect 30: An overshot assembly comprising: a proximal body portion; a distal body portion having a wall and a longitudinal axis, the wall of the distal body portion having an inner surface, an outer surface, and a proximal end, the inner surface of the wall of the distal body portion defining a central bore of the distal body portion; a spindle at least partially received within the central bore of the distal body portion, wherein the spindle has an outer surface, a proximal portion, and a distal portion; and a latching assembly operatively coupled to the distal body portion and configured for movement about and between a retracted position and a deployed position, wherein the distal body portion is configured for axial advancement relative to the spindle and the spindle is configured for axial movement but not rotational movement relative to the longitudinal axis of the distal body portion, and wherein axial advancement of the distal body portion in a proximal direction relative to the spindle is configured to effect movement of the latching assembly from its deployed position toward its retracted position.

Aspect 31: The overshot assembly of aspect 30, wherein the latching assembly comprises at least one latch member.

Aspect 32: The overshot assembly of aspect 31, wherein the wall of the distal body portion defines at least one distal radial opening extending from the outer surface of the wall to the central bore of the distal body portion, wherein the at least one distal radial opening is configured to at least partially receive the at least one latch member when the latching assembly is in the deployed position.

Aspect 33: The overshot assembly of any one of aspects 30-32, wherein the distal portion of the spindle defines a first driving surface, wherein the latching assembly is positioned in engagement with the first driving surface when the latching assembly is in the deployed position, and wherein upon axial advancement of the distal body portion in a proximal direction relative to the longitudinal axis, the first driving surface is configured to permit movement of the latching assembly toward the retracted position.

Aspect 34: The overshot assembly of any one of aspects 30-33, wherein the spindle is pivotally coupled to the proximal body portion, Aspect 35: The overshot assembly of aspect 34, wherein the proximal body portion defines a central bore, and wherein the overshot assembly further comprises: a ball joint received within the central bore of the proximal body portion; and a pivot joint element secured to the proximal portion of the spindle and at least partially received within the central bore of the proximal body portion, wherein the pivot joint element is configured for pivotal movement relative to the ball joint within the central bore of the proximal body portion.

Aspect 36: The overshot assembly of aspect 35, further comprising a proximal spring positioned within the central bore of the proximal body portion in substantial alignment with the longitudinal axis of the distal body portion, wherein the proximal spring is positioned in engagement with the ball joint.

Aspect 37: The overshot assembly of aspect 36, further comprising: a distal spring positioned within the central bore of the distal body portion in substantial alignment with the longitudinal axis of the distal body portion, wherein the distal spring is positioned between and in engagement with the wall of the distal body portion and the distal portion of the spindle.

Aspect 38: The overshot assembly of any one of aspects 30-37, wherein the outer surface of the wall of the distal body portion defines a grip portion.

Aspect 39: The overshot assembly of any one of aspects 30-38, wherein the wall of the distal body portion and the spindle define respective transverse bores that are positioned in alignment when the latching assembly is in the deployed position, and wherein when the latching assembly is in the deployed position, the transverse bores of the distal body portion and the spindle are configured to receive at least a portion of a locking pin.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. An overshot assembly comprising:

a proximal body portion;

a distal body portion having a wall and a longitudinal axis, the wall of the distal body portion having an inner surface, an outer surface, and a proximal end, the inner surface of the wall of the distal body portion defining a central bore of the distal body portion;

a spindle at least partially received within the central bore of the distal body portion, wherein the spindle has an outer surface, a proximal portion, and a distal portion;

a sleeve subassembly having a central bore and a common longitudinal axis with the distal body portion, wherein the sleeve subassembly is positioned between the proximal and distal body portions relative to the longitudinal axis;

a drive element secured to the proximal portion of the spindle;

a spring positioned between, and in engagement with, the sleeve subassembly and the drive element; and a latching assembly operatively coupled to the distal body portion and configured for movement about and between a retracted position and a deployed position, wherein the distal body portion is configured for axial advancement relative to the spindle and the spindle is configured for axial movement but not rotational movement relative to the longitudinal axis of the distal body portion, and wherein axial advancement of the distal body portion in a proximal direction relative to the spindle is configured to effect movement of the latching assembly from its deployed position toward its retracted position, wherein the outer surface of the wall of the distal body portion defines a grip portion that is positioned proximal of the latching assembly and configured for complimentary engagement by at least one hand of an operator or user of the overshot assembly to promote axial movement of the distal body portion relative to the spindle, and wherein the grip portion comprises a plurality of radially projecting features that are spaced apart relative to the longitudinal axis of the distal body portion, and wherein axial spaces between sequential radially projecting features are configured to receive at least a portion of one or more fingers of the operator or user of the overshot assembly.

2. The overshot assembly of claim 1, wherein the latching assembly comprises at least one latch member.

3. The overshot assembly of claim 2, wherein the wall of the distal body portion defines at least one distal radial opening extending from the outer surface of the wall to the central bore of the distal body portion, wherein the at least one distal radial opening is configured to at least partially receive the at least one latch member when the latching assembly is in the deployed position.

4. The overshot assembly of claim 3, wherein the distal body portion has a proximal end, and wherein the grip portion of the outer surface of the wall of the distal body portion is positioned axially between the proximal end of the distal body portion and the at least one distal radial opening of the distal body portion.

5. The overshot assembly of claim 1, wherein the distal portion of the spindle defines a first driving surface, wherein the latching assembly is positioned in engagement with the first driving surface when the latching assembly is in the deployed position, and wherein upon axial advancement of the distal body portion in a proximal direction relative to the longitudinal axis, the first driving surface is configured to permit movement of the latching assembly toward the retracted position.

6. The overshot assembly of claim 1, wherein the spindle is pivotally coupled to the proximal body portion.

7. The overshot assembly of claim 6, wherein the proximal body portion defines a central bore, and wherein the overshot assembly further comprises:

a ball joint received within the central bore of the proximal body portion; and a pivot joint element secured to the proximal portion of the spindle and at least partially received within the central bore of the proximal body portion, wherein the pivot joint element is configured for pivotal movement relative to the ball joint within the central bore of the proximal body portion.

8. The overshot assembly of claim 7, further comprising:

a proximal spring positioned within the central bore of the proximal body portion in substantial alignment with the longitudinal axis of the distal body portion, wherein the proximal spring is positioned in engagement with the ball joint.

9. The overshot assembly of claim 8, further comprising:

a distal spring positioned within the central bore of the distal body portion in substantial alignment with the longitudinal axis of the distal body portion, wherein the distal spring is positioned between and in engagement with the wall of the distal body portion and the distal portion of the spindle.

10. The overshot assembly of claim 9, wherein the distal body portion is configured for twisting movement relative to the spindle and then axial movement relative to the spindle to overcome a spring-biasing force that drives the spindle into an axial position in which the latching assembly is forced to the deployed position.

11. The overshot assembly of claim 1, wherein the distal body portion is configured for twisting movement relative to the spindle and then axial movement relative to the spindle.

12. An overshot assembly comprising:

a proximal body portion;

a distal body portion having a wall and a longitudinal axis, the wall of the distal body portion having an inner surface, an outer surface, and a proximal end, the inner surface of the wall of the distal body portion defining a central bore of the distal body portion;

a spindle at least partially received within the central bore of the distal body portion, wherein the spindle has an outer surface, a proximal portion, and a distal portion;

a sleeve subassembly having a central bore and a common longitudinal axis with the distal body portion, wherein the sleeve subassembly is positioned between the proximal and distal body portions relative to the longitudinal axis;

a drive element secured to the proximal portion of the spindle;

a spring positioned between, and in engagement with, the sleeve subassembly and the drive element; and a latching assembly operatively coupled to the distal body portion and configured for movement about and between a retracted position and a deployed position, wherein the distal body portion is configured for axial advancement relative to the spindle and the spindle is configured for axial movement but not rotational movement relative to the longitudinal axis of the distal body portion, and wherein axial advancement of the distal body portion in a proximal direction relative to the spindle is configured to effect movement of the latching assembly from its deployed position toward its retracted position.

* * * * *